United States Patent [19]

Niederer

[11] 4,349,160

[45] Sep. 14, 1982

[54] APPARATUS AND METHOD FOR WINDING YARN TO FORM A PACKAGE

[75] Inventor: Kurt W. Niederer, Charlotte, N.C.

[73] Assignee: The Terrell Machine Company, Charlotte, N.C.

[21] Appl. No.: 173,482

[22] Filed: Jul. 30, 1980

Related U.S. Application Data

[63] Continuation of Ser. No. 78,699, Sep. 25, 1979, abandoned.

[51] Int. Cl.[3] ..... B65H 54/02; B65H 54/30; B65H 54/38

[52] U.S. Cl. ..... 242/18 R; 242/18 CS; 242/18.1; 242/43 R; 242/43 A; 242/45; 242/46.4; 242/158 B

[58] Field of Search ..... 242/18 R, 18 CS, 43 R, 242/18.1, 158 B, 36, 45, 43 A

[56] References Cited

U.S. PATENT DOCUMENTS

| | | | |
|---|---|---|---|
| 1,170,212 | 2/1916 | Allen et al. | 242/158 B X |
| 2,238,128 | 4/1941 | Nydegger | 242/158 B X |
| 2,662,695 | 12/1953 | Ballard | 242/43 A |
| 3,180,584 | 4/1965 | Blunck et al. | 242/45 |
| 3,294,327 | 12/1966 | Horwood | 242/43 R |
| 3,333,782 | 8/1967 | Beckwith, Jr. | 242/43 R |
| 3,565,359 | 2/1971 | Goodhue | 242/43 R |
| 3,586,251 | 6/1971 | Burdge | 242/43 R |
| 3,620,464 | 11/1971 | Ueda et al. | 242/43 R |
| 3,717,311 | 2/1973 | Smith | 242/18 R |
| 3,831,872 | 8/1974 | Fisher et al. | 242/43 R |
| 3,860,187 | 1/1975 | Liska et al. | 242/45 |
| 3,937,409 | 2/1976 | Muller | 242/18 R |
| 3,981,458 | 9/1976 | Rogers | 242/43 R |
| 4,105,166 | 8/1978 | Mackie | 242/45 |

FOREIGN PATENT DOCUMENTS

| | | | |
|---|---|---|---|
| 642286 | 6/1962 | Canada | 242/158 B |
| 51-96546 | 8/1976 | Japan | 242/158 B |
| 474440 | 8/1969 | Switzerland | 242/158 B |
| 549395 | 6/1977 | U.S.S.R. | 242/158 B |

*Primary Examiner*—Stanley N. Gilreath
*Attorney, Agent, or Firm*—Richards, Shefte & Pinckney

[57] ABSTRACT

A textile yarn winding machine and method for winding yarn utilizing a rotatable package supporting spindle, two continuous belts movable oppositely along two respective traversal spans for traversingly moving yarn longitudinally along the package, and rotating yarn engaging fingers adjacent opposite ends of the package for positively transferring the yarn between the belts at the package ends. The belt traversal spans extend in crossing relationship from respectively opposite yarn engaging locations closely adjacent opposite ends of the package to respectively opposite disengaging locations spaced from the other package end to effect quick yarn reversals. The yarn engaging fingers move in circular reversal paths to positively engage the yarn at the disengaging locations of the spans, disengage it from the belt guiding it, and move it to the engaging location of the other belt. The rotational speed of the spindle is variable in relation to a selected yarn characteristic or feeding condition to control the package surface speed and thereby control the characteristic or condition. The longitudinal speed of movement of the belts is variable to maintain its ratio to the spindle rotational speed constant, and to periodically change such ratio to control the yarn winding angle.

49 Claims, 35 Drawing Figures

FIG. 18B
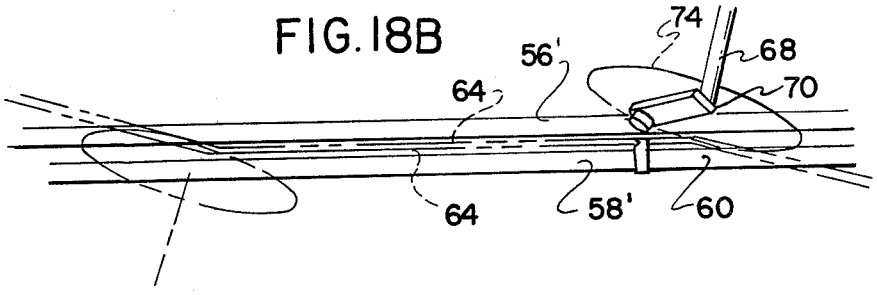
FIG. 18A
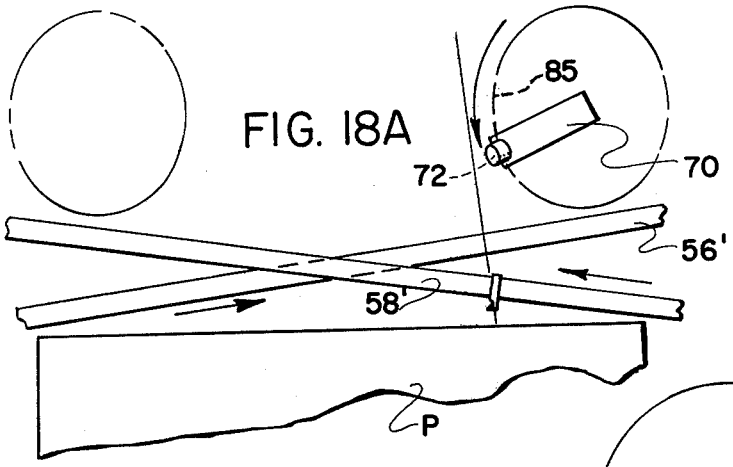
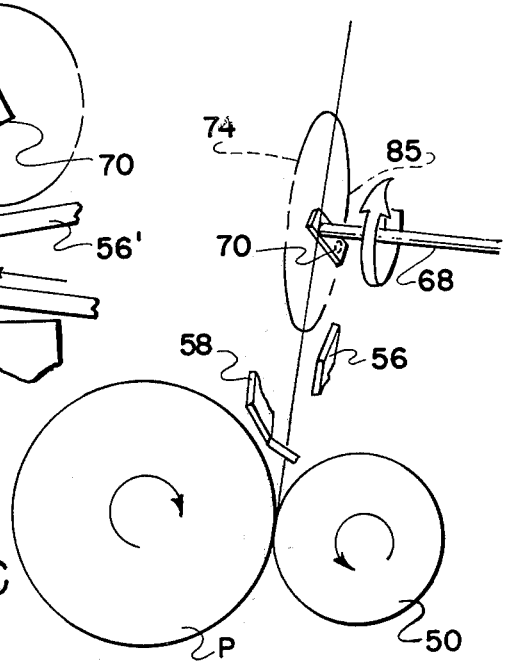
FIG. 18C

APPARATUS AND METHOD FOR WINDING YARN TO FORM A PACKAGE

CROSS-REFERENCE TO OTHER APPLICATION

This is a continuation of co-pending U.S. patent application Ser. No. 078,699, filed Sept. 25, 1979, now abandoned.

BACKGROUND OF THE INVENTION

The present invention relates to apparatus and methods for winding textile yarn or the like to form a yarn package and, more particularly, to apparatus and methods for high speed precision cross-winding by traversingly moving a yarn along a rotating package core for cross-winding of the yarn thereon.

A variety of conventional apparatus of this type are available, such devices typically utilizing a rotatable spindle for supporting and rotating the package core, and one or more moving belts, chains or the like carrying yarn engaging elements for traversingly moving yarn longitudinally along the rotating package core, the belts, chains, or the like in a number of such devices being arranged so as to have two oppositely moving operational spans extending along the package. While all or most such devices may be successfully operated to varying extents, significant limitations exist in such devices with respect to the maximum package size which can be uniformly and symmetrically built or the speed at which the spindle and traverse mechanisms can be effectively operated.

In this regard, it has been discovered that two constructional features of yarn winding apparatus of this type, specifically, the orientation of the operational spans of the belt or belts of the winding apparatus both with respect to each other and with respect to the package itself, and the manner and means of handling the reversal transfer of the yarn between the operational spans of the belt arrangement, have a substantial effect on the symmetrical building of the yarn package and, in particular, on the formation of the ends of the package where the direction of movement of the yarn along the package is reversed. It is of particular importance that the reversal at each end of the yarn package of the direction of yarn traversal be consistently accomplished as precisely and identically as possible so that the ends of the yarn package will be built symmetrically with respect to each other. Moreover, it is additionally important that the reversals at each package end be accomplished at essentially equal spacings from the package and that the reversal spacing be within an optimum range which is neither too great nor too small since both extremely quick and slow, extended reversals can have deleterious effects upon uniform package construction. For example, where the yarn being wound is engaged during reversal and reversal is effected at a significant spacing from the package, a greater number of yarn wraps per unit length of the package are placed thereon at the ends thereof than are placed at the center of the package, causing tension and density variations in the package along its length and, in some cases, breakdown of the package ends. On the other hand, the reversal of the traversal direction of the yarn at a very close spacing from the package, and thereby very quickly, will cause the yarn to be laid on the package with a sharp angular bend therein at the point of reversal which bend will be overcome by the normal tension and twist in the yarn causing it to shift and assume a minimum curvature on the package, thereby also affecting the integrity of the construction of the package ends.

Typically the means utilized in prior art devices to effect the above-described reversal transfer between the operational spans of the belt arrangement comprises stationary cams for engaging and guiding the yarn between the spans by sliding of the yarn on the cams, examples of such being illustrated in Horwood U.S. Pat. No. 3,294,327 and Beckwith U.S. Pat. No. 3,333,782. A variation of this type of yarn camming arrangement utilizing a freely rotatable cam disc disposed between the two operational spans is disclosed in Ueda U.S. Pat. No. 3,620,464. Such cam-type reversal arrangements, while generally effective for their intended purpose, suffer from several drawbacks which render winding devices utilizing this type of reversal arrangement less desirable. Initially, a cam-type reversal assembly provides no means of positively engaging the yarn during reversal. Accordingly, any factor tending to cause variations between individual reversal operations in the sliding contact between the yarn being wound and the cams effecting reversal, such as tension, friction, etc., will necessarily cause variations from reversal to reversal in both the specific location at which removal of the yarn is effected from the belt span carrying it and the specific location of the reversal transfer of the yarn to the other belt span, thereby resulting in variations in the symmetry and uniformity of construction of the yarn package and effectively limiting the maximum package size which can be built. Such variations as the coefficients of friction are common, resulting, among other things, from oil on the yarn being wound, tension variations in the yarn along the length thereof along the yarn feed path, yarn flutter and vibration along the yarn feed path, and the accumulation of dust and fly on the belt or belts or on the yarn cams. As a result, yarn winding devices utilizing such cam-type reversal arrangements are generally unacceptable for winding relatively large yarn packages. Moreover, the fluttering and vibrating along the yarn feed path of the yarn being wound and the variation in tension of the yarn along its length sometimes additionally result in insufficient contact between the yarn being wound and the cams to insure effective sliding of the yarn along the cam surface for reversal resulting in failure of the reversal operation. Finally, such cam-type reversal arrangements provide no means of maintaining tension on the yarn being wound during the reversals and, therefore, there occurs a release or collapse of yarn tension at each reversal when the yarn is removed by the cams from the moving belt or belts of such winding devices, such tension collapse causing tension variations between the yarn wound about the center of the package and the yarn wound about the package ends which results in a non-symmetrical package having inferior package flanks.

In a number of prior art devices the operational spans of the belt or belts thereof are oriented in spaced parallel relation along the path along which the yarn is delivered to the package, examples of this construction being found in the above-referenced Ueda patent and in Rogers U.S. Pat. No. 3,981,458, Ballard U.S. Pat. No. 2,662,695, and Allen U.S. Pat. No. 1,170,212. In other prior art devices, the operational belt spans extend in spaced parallel planes oriented generally perpendicularly with respect to the yarn path, the spans being oriented in their respective planes in crossing relation when viewed in the direction of yarn feeding, this arrangement being disclosed in the above-referenced Beckwith and Horwood patents, and in Goodhue U.S. Pat. No. 3,565,359, and Burdge U.S. Pat. No. 3,586,251. In each of the above types of belt arrangement and in all of the above patents, the two operational spans of the belt assembly are spaced along the yarn path thereof, whereby one of the operational spans is necessarily closer to the yarn package along the entire operational length of the span than is the other span. As a result, reversal is effected at one end of the package by transferring the yarn from the span closest to the package to the other span which is spaced a greater distance from the package, while at the other end of the package reversal is effected by transferring the yarn from the span spaced the greater distance from the package to the closest span. A relatively slower, more extended reversal is thus effected in the former instance with the reversal in the latter instance being relatively quicker, this differing treatment of the yarn at opposite ends of the package resulting in further variations in the symmetry and uniformity of the package ends.

In contrast, the present invention provides a novel apparatus and method for winding yarn by cooperatively traversingly moving a yarn along a yarn package and positively engaging the yarn at the ends of the package to effect precise and relatively quick reversals of the direction of traversing movement of the yarn in an identical manner at each end of the yarn package to maintain the number of yarn wraps per unit length of the yarn package essentially uniform along the entire package length and thereby permit the building of uniform and symmetrical yarn packages at high operational speeds.

Necessarily interrelated with the yarn traversing and reversing assemblies of yarn winding machines and the like with regard to the symmetrical building of yarn packages is the driving system in such devices for rotating the spindle and moving the belt, belts, chains or the like. It is known in the art of cross-winding yarn to form a yarn package that the yarn winding angle, i.e. the angle at which the yarn is laid on the package with respect to the package axis, must be maintained within an acceptable range to provide stability and symmetry to the package. For example, if the yarn winding angle is too steep with respect to the package axis, the yarn will tend to fall or "sluff" off the package ends. In conventional devices, a single drive motor is normally utilized to effect rotation of the spindle and longitudinal movement of the belt arrangement. Since the yarn being wound is normally fed to the winding machine at a generally constant speed, such devices are conventionally mechanically arranged to gradually and continually decrease the rotational speed of the spindle as the diameter of the package increases during the building thereof to maintain the surface speed of the yarn package generally constant in conjunction with the generally constant rate of feeding of the yarn. As a result of the driving arrangement, the longitudinal speed of movement of the belt arrangement is necessarily reduced gradually and continually also, thereby maintaining constant the ratio between the longitudinal speed of movement of the belt arrangement and the rotational speed of the spindle. The number of yarn wraps per unit axial length of package thus remains constant throughout the building of the package, accordingly causing the yarn winding angle to gradually increase and approach 90 degrees as the package diameter increases. Inasmuch as the minimum and maximum acceptable yarn winding angles are relatively fixed, it is apparent that the maximum increment of package diameter which can be built utilizing such a drive system is limited.

In Osborne U.S. Pat. No. 2,652,987, it is proposed to reduce the rotational speed of the spindle in steps as the package builds to produce a stepped reduction in the ratio between the spindle rotational speed and the speed of traversing movement of the yarn, thereby periodically reducing the number of yarn wraps per unit length of package to accordingly reduce the yarn winding angle. While this arrangement may effectively maintain the yarn winding angle within acceptable limits, since the spindle rotational speed is varied in steps only and remains constant during each step the surface of the package is in no way regulated and therefor gradually increases during each step. As a result, this arrangement would be wholly unacceptable for use in any winding operation where a selected yarn characteristic or yarn feeding condition is to be controlled by controlling the surface speed of the package during the winding operation in relation to the characteristic or condition. An example of a winding operation requiring such control is the winding of yarn or filamentary material delivered to the winding apparatus from an extruder. In such a situation, the yarn take-up speed of the package must be maintained constant to insure uniform yarn characteristics along the entire length of the yarn. Any significant increases of the surface speed of the yarn package during winding would result in the gradual increase in the tensioning of the yarn, and thereby effect essentially a drawing operation possibly causing yarn breakage, weak or thin spots in the yarn, and produce a yarn of gradually increasing denier along the length thereof.

In contrast, the present invention provides a novel apparatus and method for winding yarn packages of relatively large diameter by maintaining the yarn winding angle within acceptable limits throughout the winding operation by periodically changing the ratio between the rotational speed of the spindle and the speed of traversing movement of the yarn, while also controlling a selected yarn characteristic or yarn feeding condition by controlling the surface speed of the yarn package in relation to the characteristic or condition.

SUMMARY OF THE INVENTION

Briefly described, the apparatus and method for winding yarn accordingly to the present invention includes spindle means for rotatably supporting a package core for winding yarn thereon to form a yarn package, and yarn traversing means for effecting traversing movement of the yarn along the yarn package. The traversing means includes yarn guides movable oppositely along two traversal spans extending longitudinally of the yarn package, being engagable with the yarn to guide it alternately along the spans. Reversing means are provided adjacent each end of the package for transferring the yarn between the two traversal spans.

The two traversal spans of the traversing means extend longitudinally of the yarn package from respectively opposite yarn engaging locations adjacent the periphery of the package at opposite ends thereof toward respectively opposite yarn disengaging locations adjacent the periphery of the package at the respective other end thereof. The reversing means operates to transfer the yarn from a yarn guide at the disengaging location of one span to a yarn guide at the engaging location of the other span. Preferably, the traversing means is arranged to cause a yarn guide not engaging the yarn to move through the yarn engaging location of one traversal span as the yarn guide guiding the yarn along the other traversal span moves through the yarn disengaging location thereof for transfer of the yarn by the reversal means from the yarn guide in the other span to the yarn guide in the one span.

Yarn is delivered to the package for winding along a yarn feed path extending from a supply to the package, a freely rotatable roll being disposed for peripheral contact with the package during winding of yarn thereon, the yarn feed path extending from the supply to the roll and package for application of the yarn onto the package. In the preferred embodiment, the two traversal spans extend transversely with respect to the yarn feed path in close adjacency thereto on opposite sides thereof and in parallel planes, and are disposed generally closely adjacent the package with their yarn engaging locations generally closely adjacent the roll and the package. Preferably, the traversing means includes belt means movable oppositely along the two traversal spans, the belt means being inclined in cross-section in each traversal span to converge toward the yarn feed path in the direction of the yarn package with the yarn guides extending from the edges of the belt means closely adjacent the yarn feed path for disposition close to the package. It is also preferred that the two traversal spans be of equal length and extend angularly outwardly from the yarn package at equal inclinations with respect to the package axis. The belt means in the preferred embodiment includes two continuous belts respectively oppositely movable generally axially of the yarn package along the two traversal spans.

According to one feature of the present invention, movable reversing means is provided adjacent each end of the yarn package for transferring the yarn from a yarn guide at the yarn disengaging location of one traversal span to a yarn guide at the yarn engaging location of the other span, each reversing means having yarn engaging means arranged for movement generally transverse to the traversal spans and intersecting the yarn feed path for positively engaging the yarn as a yarn guide guiding the yarn passes through the yarn disengaging location of one traversal span and positively moving it away from and out of engagement with the guide and into position for engagement at the yarn engaging location of the other traversal span by a yarn guide moving therethrough for movement along the other traversal span. Preferably, each yarn engaging means is arranged for movement in a reversal path during each transferring thereby of the yarn between the traversal spans, the reversal path including a portion through which the yarn engaging means has one component of movement in the general direction of movement of the yarn guide in the yarn disengaging location and another component of movement generally perpendicularly away therefrom. Each reversing means is arranged to move its yarn engaging means along the portion at at least the same general speed as the yarn guide as the yarn guide moves through the yarn disengaging location of the one traversal span for positively engaging the yarn and disengaging it from the yarn guide.

In the preferred embodiment of the present invention, during every transferring of yarn between the traversal spans the yarn engaging means effecting transferral temporarily continues to engage the yarn following engagement of the yarn by the yarn guide to which the yarn was transferred, thereby maintaining tension on the yarn during transferring thereof between the traversal spans. To accomplish this in the preferred embodiment, each yarn engaging means is arranged for movement in a circular reversal path which lies in a plane inclined to the traversal spans and includes the aforementioned portion and two additional portions. Following the first-mentioned portion of the reversal path of each yarn engaging means is a second portion in which a primary component of movement of the finger means is generally normal to movement of the yarn guide in the yarn engaging location of the other traversal span to which the yarn is transferred by the yarn engaging means for advancing the yarn into position for engagement by the yarn guide moving through the yarn engaging location. Following the second portion of the circular path of each yarn engaging means is a third portion having a component of movement in the general direction of movement of the yarn guide in the yarn engaging location of the span to which the yarn is transferred by the yarn engaging means and another component of movement generally perpendicularly away therefrom for disengaging and moving away from the yarn. As a result of the aforementioned inclined orientation of the circular path of each yarn engaging means, the yarn is transferred out of the path of the guide in the yarn disengaging location into the path of the guide in the yarn engaging location and the yarn engaging means is moved out of engagement with the yarn and away from the yarn feed path after transferring the yarn. Preferably, each yarn engaging means includes a yarn engaging finger movable in the reversal path for positively engaging and moving the yarn between the traversal spans.

According to another feature of the present invention, the two traversal spans of the traversing means extend in crossing relationship angularly outwardly from the yarn package from their respective yarn engaging locations to their respective yarn disengaging locations, the yarn engaging locations being generally closely adjacent the periphery of the yarn package and the yarn disengaging locations being spaced from the periphery of the package. In this manner, during each transferring of yarn between the two traversal spans, the yarn guide to which the yarn is transferred is generally closely adjacent the yarn package and more closely adjacent the package than the yarn guide from which the yarn is disengaged so as to effect a quick and precise reversing of the direction of the traversing movement of the yarn for symmetrical controlled package building.

Thus, in the preferred embodiment of the present invention, the traversing means and the reversing means move the yarn in a yarn traversal path extending during traversal thereof generally longitudinally of the package in a plane generally parallel to the axis thereof and extending during each reversal thereof between the traversal spans in a plane inclined to the traversal path plane.

It is also preferred that the traversal spans be arranged between the yarn package and the reversing means such that the circular paths of the yarn engaging means of the reversing means intersect the yarn feed path outwardly of the package beyond the traversal spans.

According to another feature of the present invention, the spindle means includes variable spindle driving means for rotating the package at varying rotational speeds to control the surface speed of the package in relation to a selected yarn characteristic or yarn feeding condition to thereby control the characteristic or condition. The yarn traversing means includes traverse drive means for causing the traversing means to move the yarn longitudinally along the package, the traverse driving means being variable for varying the longitudinal speed of traversing movement of the yarn for regulation of the relationship thereof with the rotational speed of the package to thereby control the angle with respect to the axis of the package at which the yarn is wound onto the package. According to this feature of the present invention, spindle sensing means and traverse sensing means are provided for at least periodically detecting, respectively, the speed of rotation of the package during the building thereof and the speed of traversing movement of the yarn. Control means is operatively associated with both the spindle sensing means and the traverse sensing means for monitoring the respective values detacted thereby and for comparing the values to discern the ratio therebetween, and is also operatively associated with the traverse drive means for varying the speed of traversing movement of the yarn in response to the comparison to control the ratio. The control means is provided with a plurality of predetermined ratio values and is programmed to operate the traverse drive means so as to maintain the ratio at each value for a respective preselected interval in a predetermined order of the ratio values to maintain the yarn winding angle within a predetermined acceptable range throughout the yarn winding operation for symmetrical building of large yarn packages.

In a preferred embodiment of the present invention, the selected yarn characteristic or feeding condition to be controlled is the speed of yarn take-up by the package, the variable spindle drive means including package sensing means for continuously detecting the surface speed of the package. Preferably, the package sensing means is arranged to detect the surface speed of the freely rotatable roll which, as a result of its peripheral rotational contact with the package during winding, rotates at the surface speed of the package. The control means in this embodiment is independently operably associated with the spindle drive means for comparing the surface speed of the package with a predetermined standard value and varying the rotational speed of the package to maintain constant the surface speed of the package, thereby maintaining constant the speed at which the yarn is taken up by the package.

BRIEF DESCRIPTION OF THE DRAWINGS

FIGS. 11A, 11B, 11C to 18A, 18B, 18C are views illustrating sequentially one complete reversal operation, each figure designated by "A" corresponding to FIG. 8, each figure designated by "B" corresponding to FIG. 9, and each figure designated by "C" corresponding to FIG. 10.

DESCRIPTION OF THE PREFERRED EMBODIMENT

Figure 1:
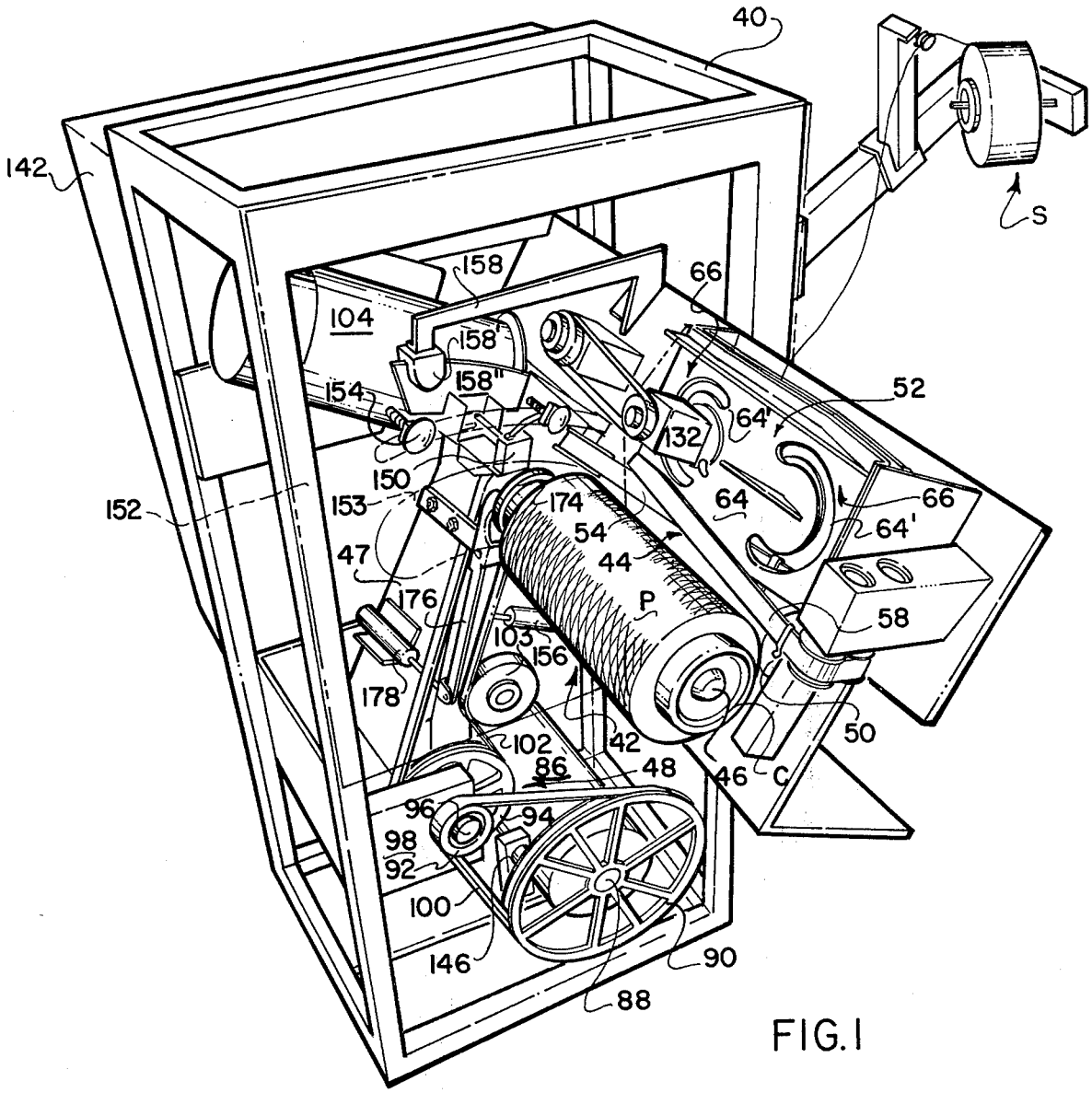
FIG. 1 is a perspective view of a textile yarn winding machine according to the preferred embodiment of the present invention.

Referring now to the accompanying drawings, the preferred embodiment of the apparatus and method of the present invention for winding yarn from a supply into a yarn package is illustrated generally in FIG. 1. All of the components of the winding machine of the present invention are mounted on an upstanding machine frame 40. A spindle arrangement, indicated generally at 42, is provided for rotatably supporting a yarn package core C for winding yarn thereon to form a yarn package P. A separate yarn-traversing structural arrangement is provided for effecting traversing movement of the yarn along the yarn package during winding and is indicated generally at 44.

Generally, the spindle arrangement 42 includes a rotatable spindle 46 extending from the free end of a spindle arm 47 pivotably affixed at its other end to the machine frame 40 at 49, about which spindle 46 a tubular yarn package core C may be mounted for winding thereon yarn delivered from a supply S upon the application of the yarn onto the core C during rotation thereof. To impart rotational movement to the spindle 46 and thereby to the package core C, the spindle arrangement 42 also includes a spindle driving assembly, indicated generally at 48 in FIG. 1 and more fully described hereinafter. Yarn is delivered to the yarn package P from the supply S along a yarn feed path F generally tangentially to the yarn package P for wrapping about the periphery thereof. To effect application of the yarn onto the package P, a freely rotatable pressure roll 50 is rotatably mounted between components of the machine frame 40 in axially parallel ralation with the spindle 46 for peripheral rotational contact with the package P during rotation thereof and the winding of yarn thereon, the yarn being fed along its yarn feed path F between the roll 50 and the package P for application of the yarn onto the package P upon rotation thereof.

Figure 7:
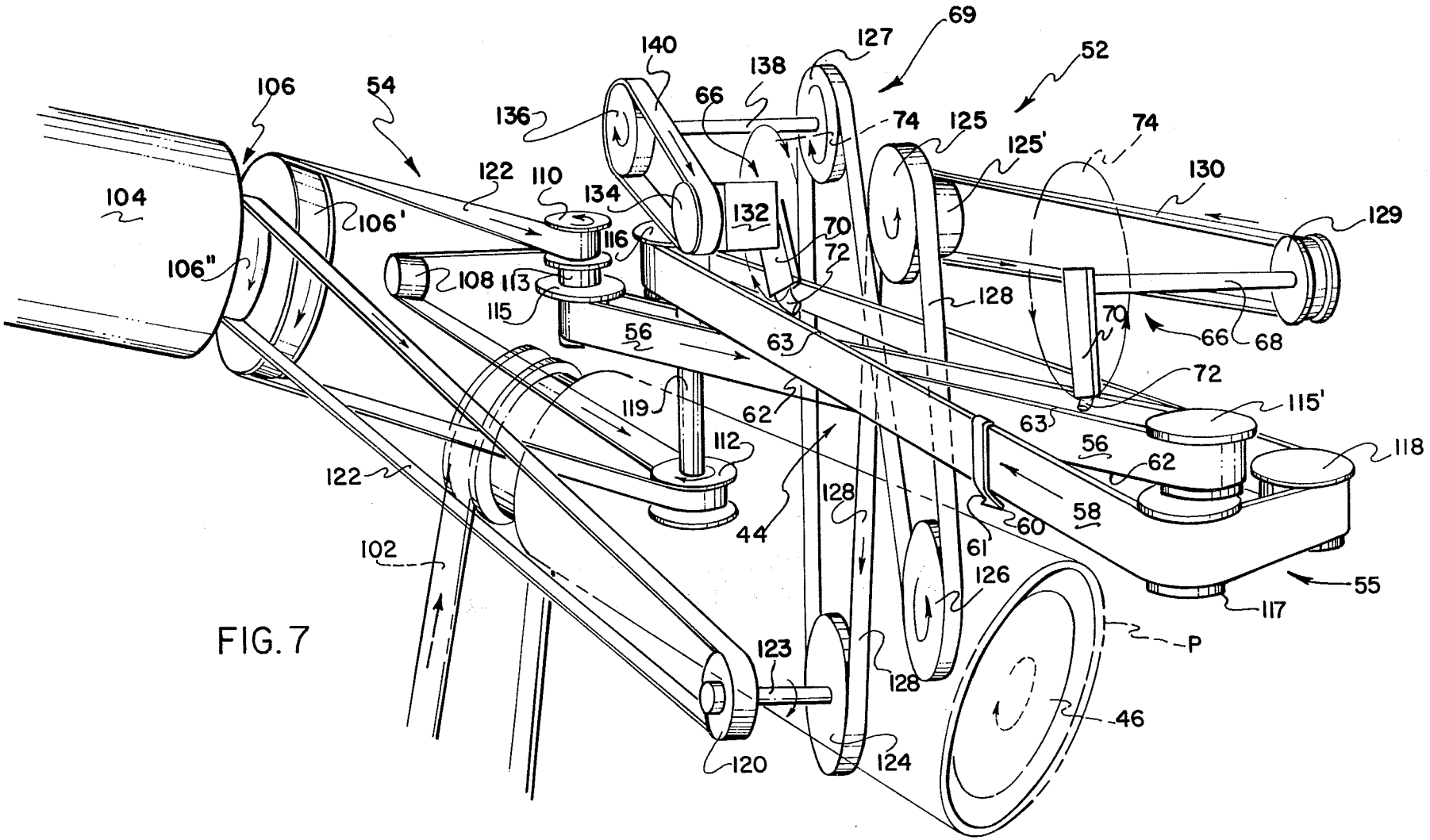
FIG. 7 is a perspective view of the yarn traversing and reversing arrangements of the winding machine of FIG. 1.
Figure 8:
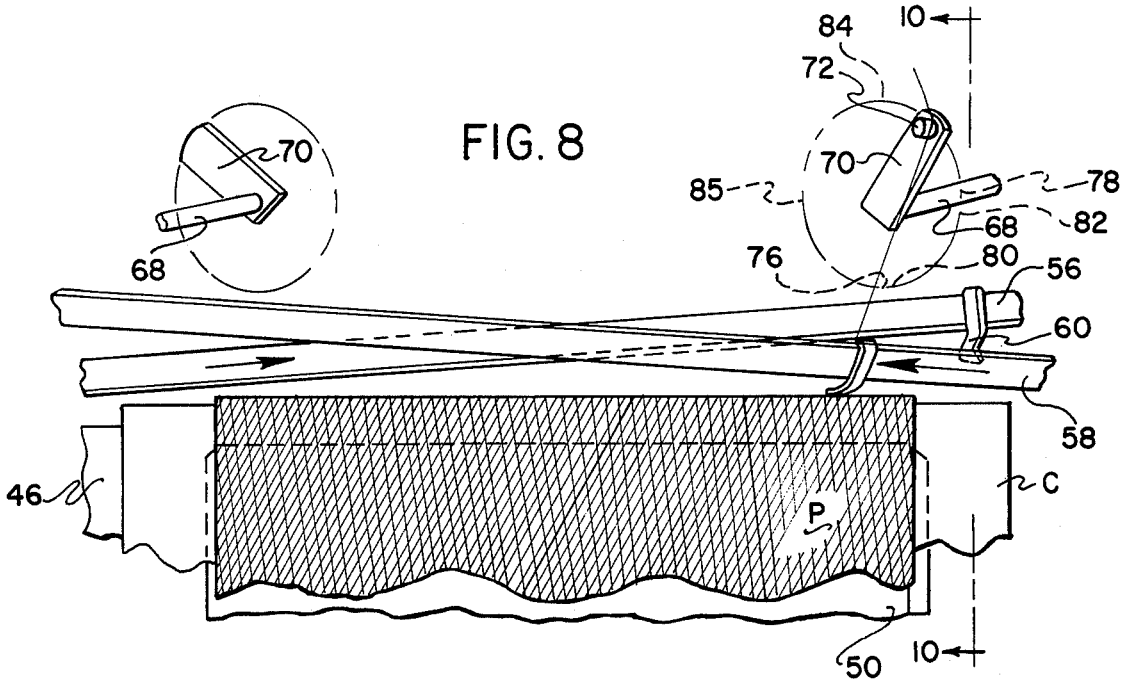
FIG. 8 is a detailed front view of the yarn traversing and reversing arrangements of the winding machine of FIG. 1 taken perpendicularly with respect to the yarn feed path.

Basically, the yarn traversing arrangement 44 includes a belt assembly comprising two continuous timing belts 56, 58 and a traverse drive assembly, indicated generally at 54, including a pulley system, indicated generally at 55, about which the belts 56, 58 are trained for movement longitudinally of the yarn package P generally axially with respect thereto and generally transversely with respect to the yarn feed path F along two respective oppositely moving traversal spans 56', 58', all as best seen in FIG. 7. As will be evident to those skilled in the art, a single belt trained about an appropriate pulley system to follow two oppositely moving traversal spans could also be utilized for this purpose. The belts 56, 58 are provided with yarn guides 60 affixed thereto for movement therewith along their respective traversal spans 56', 58', the guides 60 having hooks 61 engageable with the yarn to guide it within its yarn feed path F alternately along the traversal spans 56', 58' to effect the desired traversing movement of the yarn along the package P. A movable reversal arrangement, indicated generally at 52, is provided adjacent each end of the yarn package P for positively engaging and transferring the yarn between yarn guides 60 of the two oppositely moving traversal spans 56', 58' at the ends of the package P for continuance of the traversing of the yarn.

The pulley system 55 about which the two belts 56, 58 are trained, which pulley system 55 is hereinafter more fully described, is arranged to cause each belt 56, 58 to extend and move along its respective traversal span from a yarn engaging location closely adjacent the periphery of the yarn package P at one end thereof angularly outwardly from the yarn package P toward a yarn disengaging location spaced from the periphery of the package P at the other end thereof. With this pulley and belt arrangement, the traversal spans 56', 58' of the two belts 56, 58 extend in crossing relation along the package P from respectively opposite yarn engaging locations generally closely adjacent the package periphery at opposite ends thereof angularly outwardly at equal inclinations to the package axis, preferably approximately six degrees (6°), toward respectively opposite yarn disengaging locations generally equally spaced from the periphery of the package P at the respective other ends thereof. Thus, the traversal span 56' of the belt 56 extends from a yarn engaging location 56'' generally closely adjacent the package periphery at one end thereof outwardly to a yarn disengaging loaction 56''' spaced from the other end of the package (See FIG. 11A). The traversal span 58' of the belt 58 extends from a corresponding yarn engaging location 58'' generally closely adjacent the periphery of the package P at the end thereof opposite the end of the yarn engaging location 56'' outwardly toward that package end to a yarn disengaging location 58''', all as can best be seen in FIG. 11A. The respective lengths of the traversal spans 56', 58' between their respective yarn engaging locations 56'', 58'' and yarn disengaging locations 56''', 58''' are thus equal, with the length of each belt 56, 58 being a multiple of the length of the traversal spans 56', 58'.

The reversal arrangement 52 is constructed and operated in a manner hereinafter more fully described to transfer the yarn between the two traversal spans 56', 58' at each package end by positively engaging and moving the yarn from the yarn guide 60 of the belt guiding the yarn toward that package end along the traversal span of the belt at the yarn disengaging location of the traversal span of such belt, to a yarn guide 60 of the other belt at the yarn engaging location of the traversal span thereof, for traversing movement of the yarn along the other traversal span. To facilitate relatively quick reversals, the belts 56, 58 are operated in a syncronous manner to cause a yarn guide 60 of the belt not engaging and moving the yarn during any given traversing movement of the yarn along the package P to generally converge with the yarn guide 60 of the belt guiding the yarn at the reversing arrangement at the end of the package toward which the belt guiding the yarn is moving the yarn and to move though the yarn engaging location of the traversal span of its respective belt as the yarn guide 60 guiding the yarn along the traversal span of its respective belt moves through the yarn disengaging location thereof, for transfer of the yarn between the respective guides 60 by the reversal arrangement. In this manner, during each transferring of yarn between the two traversal spans 56', 58' by the reversing arrangement 52 the yarn guide 60 in the yarn engaging location to which the yarn is transferred is generally closely adjacent the package periphery and more closely adjacent thereto than the yarn guide 60 in the yarn disengaging location from which the yarn is transferred. Consequently each reversal operation is performed relatively quickly and precisely at a location generally closely adjacent the package P to promote symmetrical, controlled package building without the problems associated with conventional extended reversals as hereinbefore discussed.

In the preferred embodiment, the belts 56, 58 and their associated pulley system 55 are also arranged such that their respective traversal spans 56', 58' are disposed in the aforedescribed crossing relationship adjacent the location of peripheral contact between the package P and the rotatable roll 50 with their respective yarn engaging locations 56'', 58'' generally closely adjacent the location of such peripheral contact, and such that the traversal spans 56', 58' extend along the package P in such disposition in parallel planes generally parallel to and on opposite sides of the yarn feed path F in close adjacency thereto. Each belt 56, 58 includes edges 62, 63 extending longitudinally therealong and is generally flat between its edges 62, 63 and along its longitudinal extent, the preferred belt and pulley arrangement being such to incline each belt 56, 58 in transverse cross-section along its respective traversal span 56', 58' so as to converge toward the yarn feed path F in the direction of the yarn package P to dispose the edge 62 of each belt 56, 58 more closely adjacent the yarn feed path F. The yarn guides 60 extend angularly from the edge 62 of each belt 56, 58 for disposition generally closely adjacent the package P and for intersection with the yarn feed path F during movement of the guides 60 along the respective traversal paths 56', 58' of their respective belts 56, 58. In this manner, the belts 56, 58 are each disposed and extend along their respective traversal spans 56', 58' along the package P in identical but reversed orientation thereto generally closely adjacent the location at which the yarn is actually applied thereto, with the disposition of the traversal spans 56', 58' of the belts 56, 58 generally closely adjacent the feed path F, the cross-sectional inclination of the belts 56, 58 along their spans 56', 58', and the angular extension therefrom of their respective guides 60 together causing the guides 60 thereof to intersect the yarn feed path F during movement of their respective belts 56, 58 along their traversal spans 56', 58' for effecting the traversing movement of the yarn while maintaining the belts 56, 58 in their respective spans 56', 58' sufficiently spaced from the yarn feed path F to permit normal fluttering of the yarn along the yarn feed path F and other variations in the feeding of yarn without contact occurring between the belts 56, 58 and the yarn.

In certain conventional devices, a rotatable roll, such as the roll 50, is disposed for peripheral contact with the package P, with the yarn to be wound onto the package P being fed tangentially to the rotatable roll at a location on the periphery thereof circumferentially spaced from the point of peripheral contact between the roll and the package, the yarn following the periphery of the roll during rotation thereof with the package and being applied to the package at the point of peripheral contact between the roll and the package. As those skilled in the art will readily understand, the present invention is equally adaptable to this type of conventional yarn feeding arrangement by arranging the belts 56, 58 in the above-described disposition at the location on the periphery of the rotatable roll at which the yarn is fed thereonto, the respective yarn engaging locations of the belts 56, 58 in this type of feeding arrangement being generally closely adjacent the periphery of the roll and more closely adjacent thereto than the yarn disengaging locations of the belts 56, 58 and therefore being generally closely adjacent the package periphery as well.

Referring now to FIGS. 1 and 7, the aforementioned reversing arrangement 52 is disposed outwardly of the spindle 46 beyond the traversal spans 56', 58' of the belts 56, 58 and includes two yarn guide plates 64 extending between and affixed to components of the machine frame 40 in closely spaced relation, the yarn extending along its yarn feed path F between the plates 64 during the winding operation. The reversing arrangement 52 also includes two yarn engaging finger assemblies 66 disposed in spaced relation along the plates 64 adjacent opposite ends of the spindle 46 and, thereby, adjacent opposite ends of the package P during winding. Each yarn engaging finger assembly 66 includes a rotatable shaft 68, driven in a manner hereinafter described by a pulley assembly, indicated generally at 69, operated in conjunction with the aforementioned pulley system 55 for the belts 56, 58, and an arm 70 affixed to and extending radially from the shaft 68 for rotation therewith. Affixed to and extending from the end of each arm 70 is a yarn engaging finger 72 which, upon rotation of its associated shaft 68, moves in a circular reversal path, indicated generally at 74 in FIG. 7, extending between the guide plates 64 through a slot 64' therein in intersection with the yarn feed path F.

Figure 9:
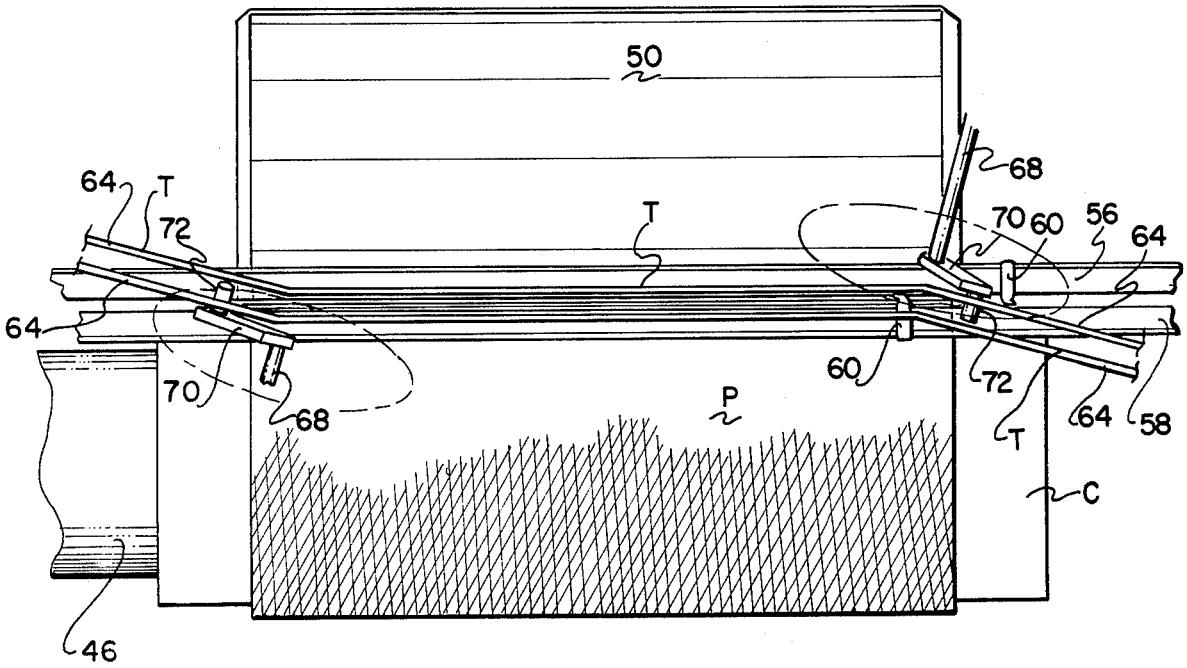
FIG. 9 is a detailed top view of the yarn traversing and reversing arrangements of FIG. 8 taken in the direction of the yarn feed path.
Figure 10:
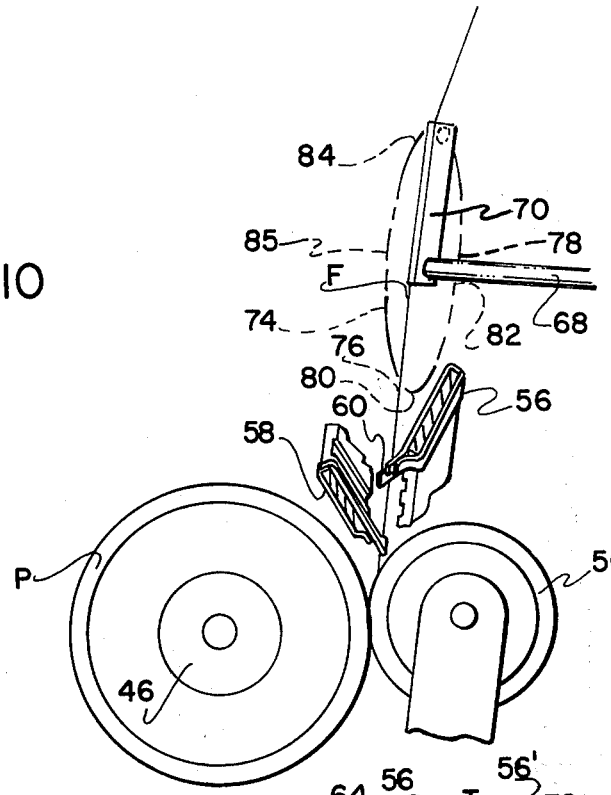
FIG. 10 is a detailed side view of the yarn traversing and reversing arrangements of FIG. 8 taken along line 10—10 of FIG. 8.

To facilitate the aforementioned positive transferring of the yarn out of the path of the guide 60 moving the yarn along the package P along one traversal span into the path of a guide 60 at the yarn engaging location of the other traversal span, each yarn engaging finger assembly 66 is oriented in its respective disposition such that the circular reversal path 74 of its yarn engaging finger 72 extends generally transversely with respect to the traversal spans 56', 58' in a plane inclined transversely with respect to the traversal spans 56', 58' and the respective parallel planes in which they extend, between points adjacent such planes, and includes points, indicated generally at 76, generally adjacent and corresponding to the yarn disengaging location of the traversal span of the belt which moves therealong toward the end of the package at which the reversing finger assembly is disposed, and points, indicated at 78, generally adjacent and corresponding to the yarn engaging location of the other belt, as can best be seen in FIGS. 9 and 10. The pulley assembly 69 of each yarn engaging finger assembly 66 is operated in a manner to cause the shaft 68 thereof to rotate at a speed sufficient to cause the yarn engaging finger 72 thereof to move at a peripheral speed at least generally the same as and preferably greater than the longitudinal speed of movement of the belts 56, 58 along their respective traversal spans 56', 58' and to move in a direction during such rotation from the points 76 of correspondence to the yarn disengaging location of the belt moving toward the end of the package at which the yarn engaging finger assembly 66 is disposed, to the points 78 of correspondence to the yarn engaging location of the other belt. In this manner, the yarn engaging finger 72 of each yarn engaging finger assembly 66 intersects the yarn feed path F at the points 76 on its circular reversal path 74 corresponding to the yarn disengaging location of the traversal span of the belt moving toward the end of the package at which the yarn engaging finger assembly 66 is disposed.

Figure 11B:
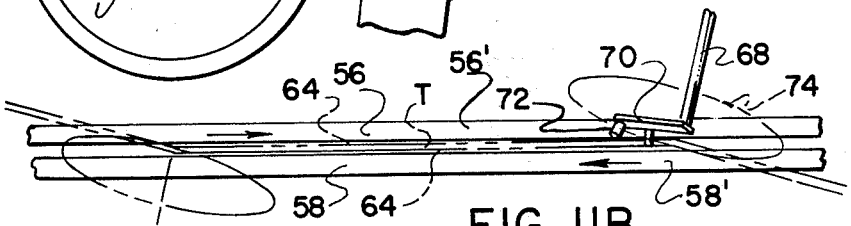
Figure 11A:
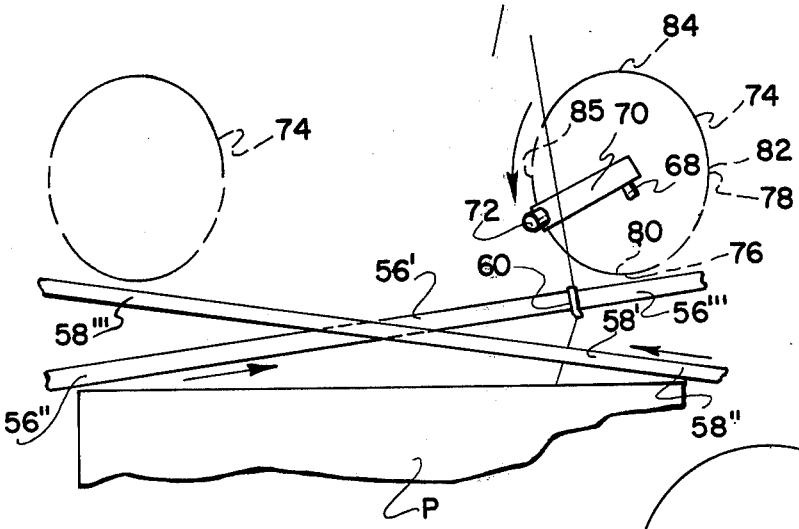
Figure 11C:
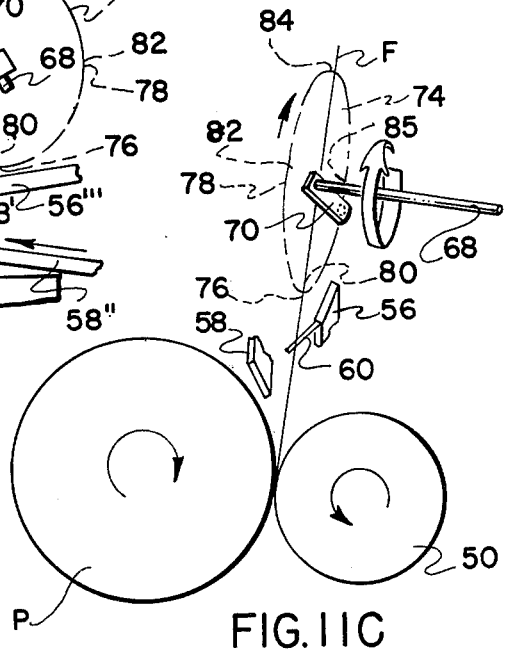
Figure 12B:
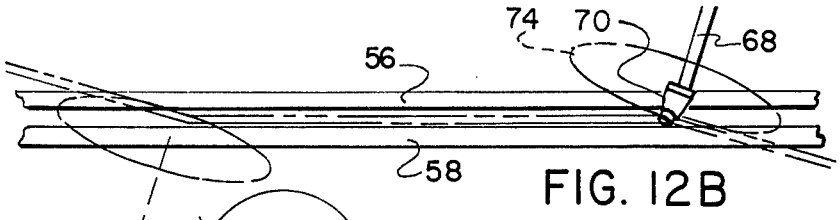
Figure 12A:
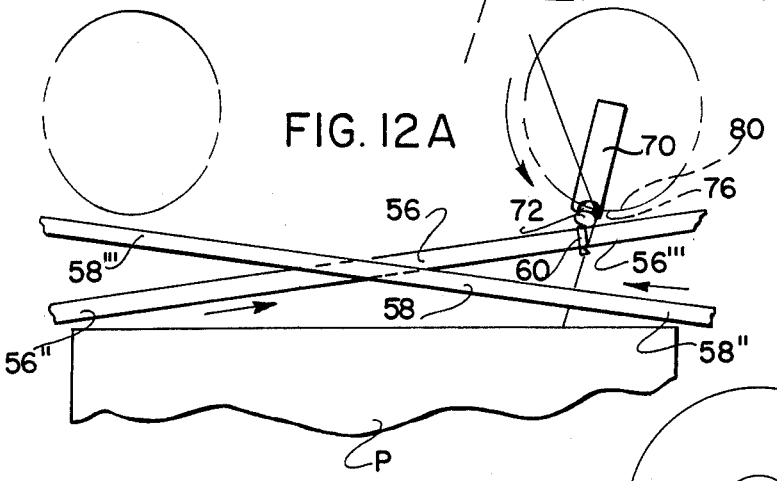
Figure 12C:
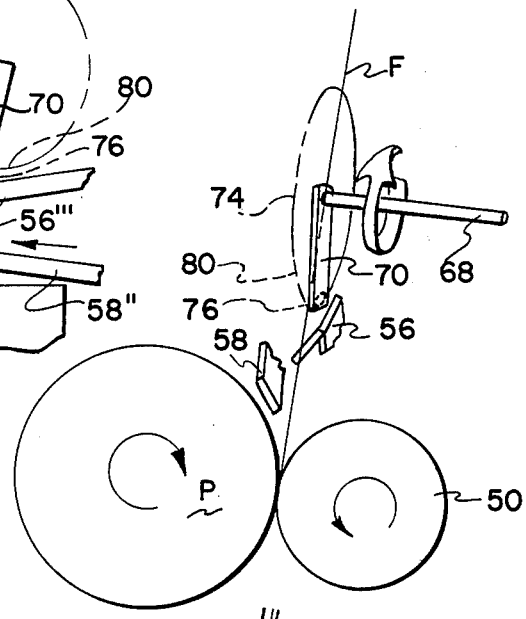
Figure 13B:
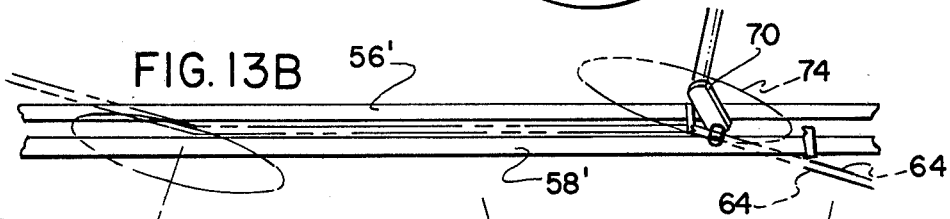
Figure 13A:
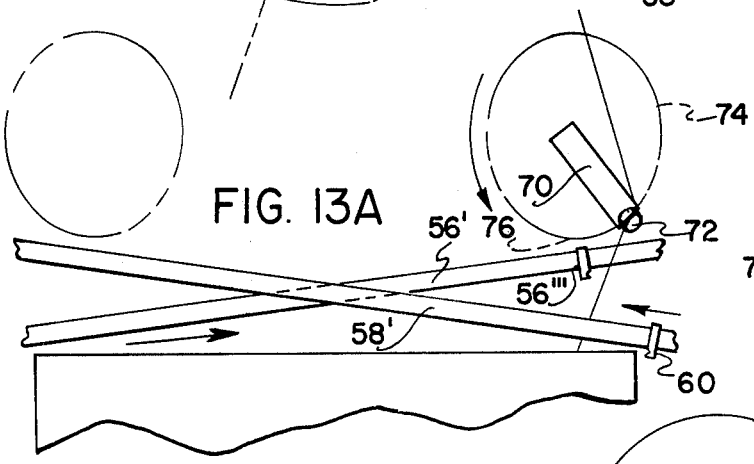
Figure 13C:
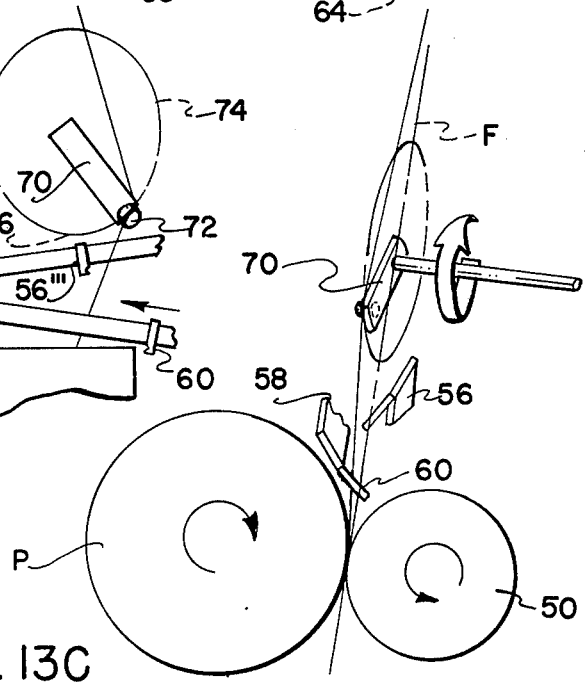
Figure 14B:
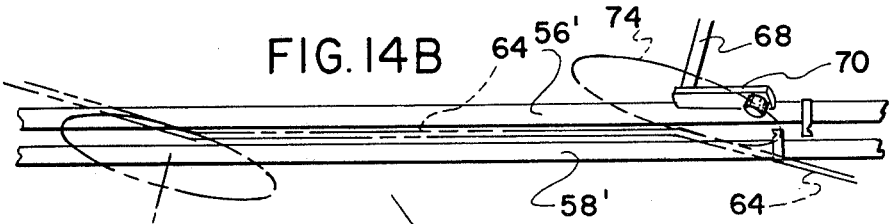
Figure 14A:
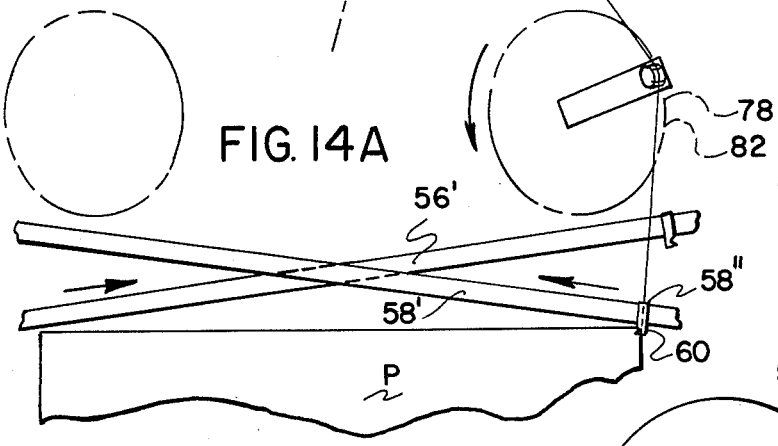
Figure 14C:
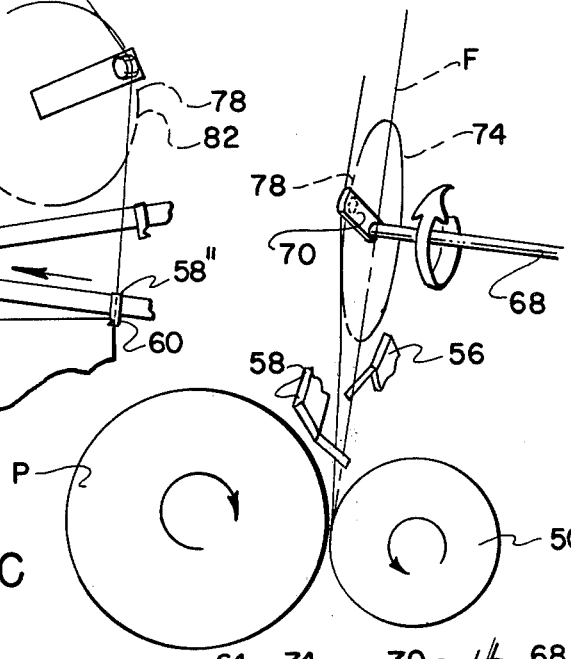
Figure 15B:
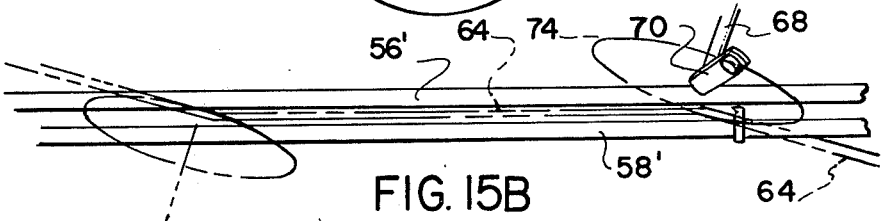
Figure 15A:
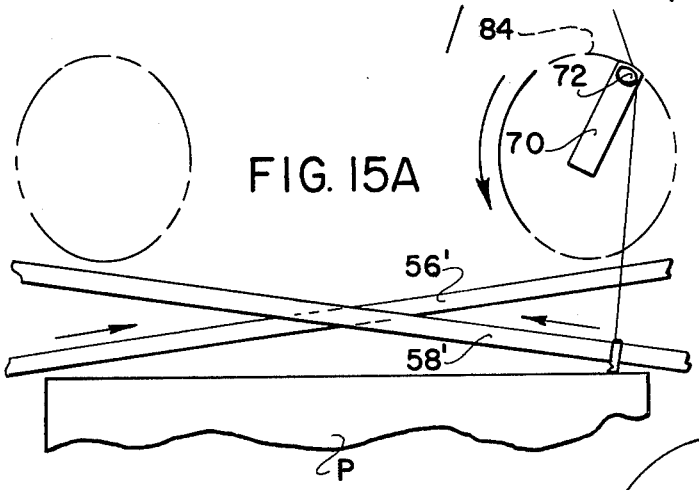
Figure 15C:
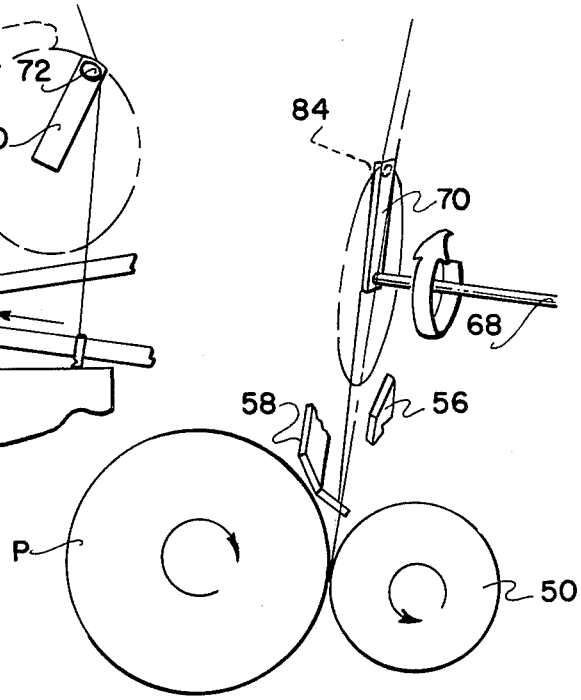
Figure 16B:
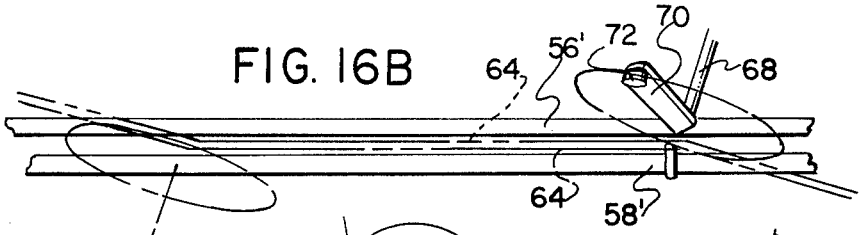
Figure 16A:
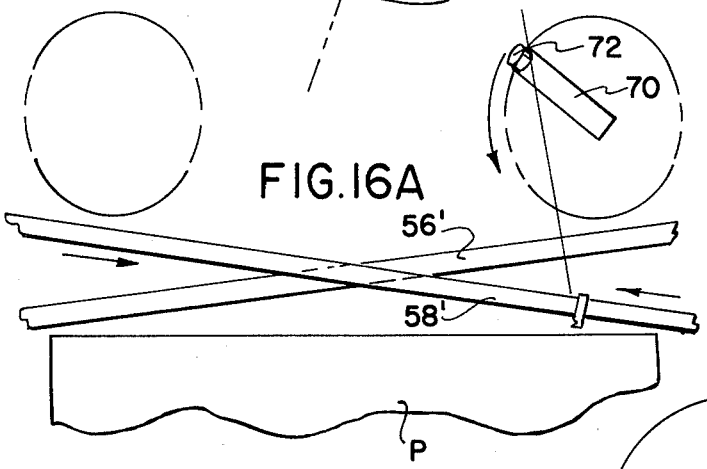
Figure 16C:
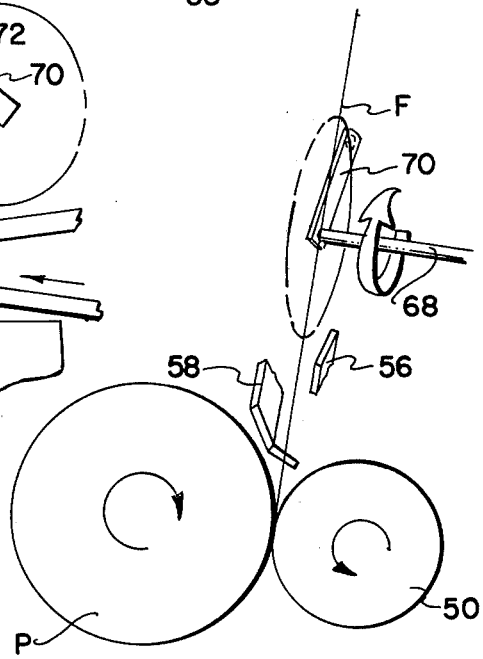
Figure 17B:
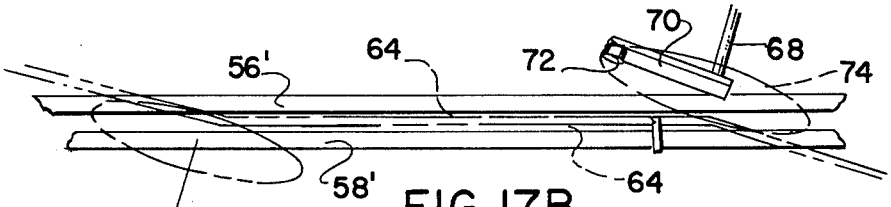
Figure 17A:
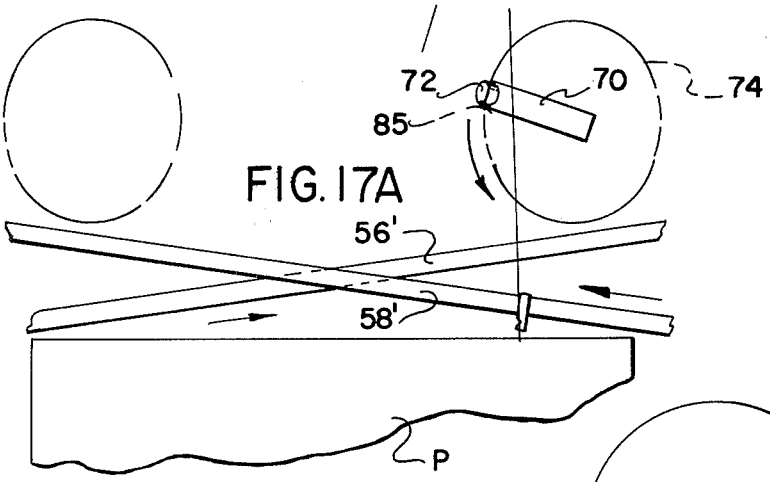
Figure 17C:
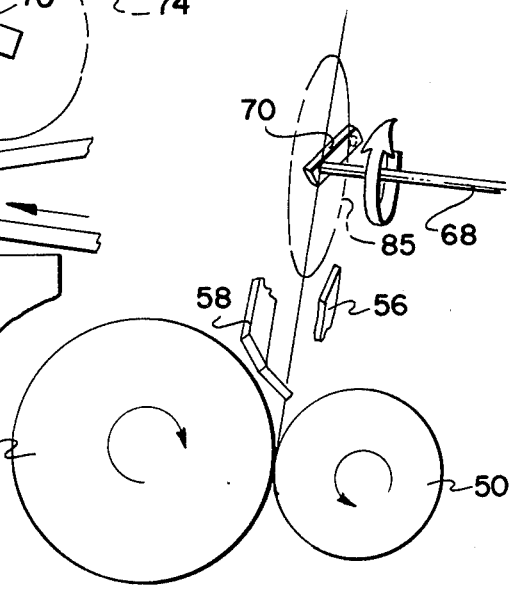

The operation of one yarn engaging finger assembly 66 during one reversal operation is illustrated sequentially in FIGS. 11A–C to 18A–C, with each step in the sequence being illustrated from three different views: (a) viewed perpendicularly with respect to the yarn feed path, (b) viewed in the direction of the yarn feed path, and (c) viewed from the end of the package at which the reversal operation takes place. In FIGS. 11A–C, the yarn is shown engaged by a yarn guide 60 moving along the traversal span 56' of the belt 56 toward the yarn disengaging location 56''' thereof. The yarn engaging finger 72 of the yarn engaging finger assembly 66 is at the location in its circular reversal path 74 adjacent the aforementioned parallel plane in which the belt 56 moves along its traversal span 56' (See FIG. 11A). In FIGS. 12A–C, the yarn guide 60 of the belt 56 is beginning to move through the yarn disengaging location 56''' of the traversal span 56' (FIG. 12A). The yarn engaging finger 72, having moved arcuately in its inclined circular reversal path 74 from the position thereof shown in FIGS. 11A–C, is beginning to move through the points 76 of its circular path 74 corresponding to the yarn disengaging location 56''' of the traversal span 56' and to intersect the yarn feed path F and thereby engage the yarn (FIG. 12C). In FIGS. 13A–C, the yarn engaging finger 72 has positively engaged the yarn and disengaged it from the yarn guide 60 by the speed and direction of movement of the finger 72, and has moved arcuately in its inclined circular reversal path 74 a sufficient distance to move the yarn out of the longitudinal path of movement of the yarn guide 60 from which it was disengaged (FIG. 13C). A yarn guide 60 of the other belt 58 is approaching the yarn engaging position 58'' of the traversal span 58' thereof. In FIGS. 14A–C, the yarn engaging finger 72 is at the location in its circular reversal path 74 adjacent the aforementioned parallel plane in which the belt 58 moves along its traversal span 58' and is moving through the points 78 of its circular reversal path 74 corresponding to the yarn engaging location 58'' of the traversal span 58', to positively move the yarn into position for presentation to and engagement by a yarn guide 60 of the belt 58 which guide 60 is moving through the yarn engaging location 58'' thereof. It can be seen that during the operation of the yarn engaging finger assembly 66 illustrated in FIGS. 12A–C, 13C–C, and 14A–C, the two guide plates 64 act as yarn cams to aid the reversing finger 72 in moving the yarn out of the path of the yarn guide 60 carrying it and transferring the yarn to a yarn guide 60 of the other belt. In FIG. 15A–C, the yarn guide 60 has moved through the yarn engaging location 58'' and is moving along the traversel span 58', the yarn engaging finger 72 remaining in positive engagement with the yarn as it begins to move arcuately along its circular reversal path 74. In each of FIGS. 16A–C, 17A–C and 18A–C, the yarn guide 60 is illustrated at successive locations in its movement along the traversal span 58′ from its position in FIG. 15A–C, the yarn engaging finger 72, however, by virtue of its speed and direction of movement having moved arcuately along its circular path 74 below the yarn feed path F and out of engagement with the yarn.

Thus, in effecting transferral of the yarn between the traversal spans 56′, 58′ of the belts 56, 58, the yarn engaging fingers 72 each pass through three arcuate portions of their circular reversal paths. In the first arcuate portion, indicated generally at 80, each yarn engaging finger 72 moves through the points 76 of its respective circular path 74 corresponding to the yarn disengaging location of the traversal span of the belt moving toward the end of the package at which the finger is disposed, the path of the finger through this portion 80 having one component of movement in the general direction of movement of such belt along its traversal span and another component of movement generally perpendicularly away therefrom (FIGS. 12A–C). In a second arcuate portion, following the first portion 80 and indicated generally at 82, each yarn engaging finger 72 passes through the points 78 of its respective circular reversal path corresponding to the yarn engaging location of the traversal span of the other belt, the primary component of its movement in the arcuate portion 82 being generally normal to the movement of the belts 56, 58 (FIGS. 13A–C and 14A–C). Each yarn engaging finger assembly 66 is operated in syncronization with the movement of the belts 56, 58 to cause each yarn engaging finger 72 to move through the points 76 corresponding to such yarn disengaging location as the yarn guide 60 of the belt carrying the yarn moves therethrough and to move through the points 78 corresponding to the yarn engaging location of the other belt as a yarn guide 60 of the other belt moves therethrough. In this manner, each yarn engaging finger 72, during its movement through the first arcuate portion 80, engages the yarn and effects disengagement thereof from the hook 61 of the guide 60 carrying the yarn by the greater speed of movement of the finger 72, and, during its movement through the second arcuate portion 82, advances the yarn into position for engagement by the yarn guide 60 moving through the yarn engaging location of the other belt. In a third arcuate portion, following the second portion and indicated generally at 84, each yarn engaging finger 72 has a component of movement in the general direction of movement of the yarn guide 60 to which the yarn was transferred during the movement of the finger 72 through the second arcuate portion 82 and another component of movement generally perpendicularly away therefrom, so as to disengage and move away from the yarn and away from the yarn feed path F by the speed of movement of the finger 72. After moving through the third arcuate portion 84 and prior to again moving through the first arcuate portion 80, each yarn engaging finger 72 moves away from the yarn feed path F through an arcuate portion 85 in which the yarn engaging finger 72 moves outwardly of the plates 64 in a direction generally normal with respect to the movement of the belts 56, 58, thereby preventing accidental re-engagement of the yarn by the finger 72 (See FIGS. 11A–C and 18A–C).

Thus, during each transferring of yarn between the traversal spans 56′, 58′ the yarn engaging finger 72 effecting the transferral temporarily continues to engage the yarn following the engagement of the yarn by the yarn guide 60 to which the yarn was transferred, thereby maintaining tension on the yarn during the transferral. In this manner, the belts 56, 58 and the yarn engaging finger assemblies 66 cooperate to move the yarn longitudinally along the package P in a yarn traversal path, indicated generally at T in FIG. 9 by the cross-sectional shape of the guide plate 64 between which the yarn is traversed, which traversal path T extends during traversal of the yarn generally longitudinally of the package P in a plane generally parallel to the axis of the package P and, during each reversal of the yarn between the traversal spans 56′, 58′ in a plane inclined with respect to the traversal path plane.

As those skilled in the art will readily understand, the present invention may be prepared for operation by placing a cheese, spool or other package from which yarn is to be cross-wound by the present invention onto a package P on the supply assembly S of FIG. 1, threading the free end of the yarn of such cheese between the plates 64, between the belts 56, 58, and between the spindle 46 and the roll 50 and wrapping a short length of the yarn around an empty package core C on the spindle 46. Upon actuation of the spindle and yarn traversing drive assemblies 48 and 54, respectively, the yarn extending between the belts 56, 58 is engaged by a guide 60 of one belt and the winding process is begun in the herein described manner. Conventional devices are available for facilitating this threading and starting procedure and, as those skilled in the art will recognize, may be adapted for use with the present invention. It is also contemplated that a device for this purpose may be specifically designed for use with the present invention. However, such a device forms no part of the invention defined herein.

The aforementioned traverse drive assembly 54 can best be seen in FIG. 7, and includes a conventionl electrically-operated motor 104 for rotating a main drive pulley, indicated generally at 106, affixed to the drive shaft, not visible in FIG. 7, of the motor 104 for driving pulley systems 55 and 69 to effect movement of the belts 56, 58 and the yarn engaging fingers 72 in the hereinabove described manners. The main drive pulley 106 comprises two toothed drive pulleys 106′, 106″ of different diameters, the larger diameter pulley 106′ being provided for driving the two belts 56, 58 of the belt assembly of the yarn traversing arrangement 44 and the pulley 106″ being of a smaller diameter for driving the yarn engaging finger assemblies 66 and rotating the yarn engaging fingers 72 thereof at a peripheral speed greater than the longitudinal speed of movement of the belts 56, 58.

Rotatably mounted on machine frame portions, not shown, are three toothed intermediate pulleys 108, 110, 112 of the pulley system of the traverse drive assembly 54, a timing belt 114 being trained about the three pulleys 108, 110, 112 and the drive pulley 106′ of the main drive pulley 106 for transmitting rotational movement to the intermediate pulleys 108, 110, 112, all as best seen in FIG. 7. Belt 56 of the belt assembly of the yarn traversing arrangement 44 is a toothed timing belt and is trained about two rotatable toothed pulleys 115, 115′, belt pulley 115 being rigidly affixed coaxially with the intermediate pulley 110 to a shaft 113 affixed to and extending from the pulley 110 for imparting longitudinal movement to the belt 56 upon rotation of the pulley 110 by the drive pulley 106′. Similarly, belt 58 is a toothed timing belt trained about three rotatable toothed pulleys 116, 117, 118, the belt pulley 116 being rigidly affixed coaxially with the intermediate pulley 112 to a shaft 119 affixed to and extending from the intermediate pulley 112 for imparting longitudinal movement to the belt 58 upon rotation of the pulley 112 by the drive pulley 106'. To prevent engagement of the flanges of the pulleys 115, 115', 116, 117, 118 by the guides 60 of the respective belts 56, 58 trained thereabout upon passage of the guides 60 around the pulleys during longitudinal movement of their respective belts 56, 58, the pulleys may be notched in a conventional manner to accommodate the guides 60 during movement thereof around the pulleys or the pulleys may be provided with one flange of reduced diameter, as illustrated in FIG. 7. The main drive pulley 106, and consequently the drive pulley 106', are rotated in a clockwise direction as viewed in FIG. 7 and as is indicated by the arrows appearing in FIG. 7. Thus, as is also indicated by directional arrows in FIG. 7, the intermediate pulleys 110 and 112 rotate oppositely thereby imparting opposed longitudinal movement to the belts 56, 58 along their traversal spans 56', 58'.

The aforementioned pulley assembly 69 of the reversing finger assemblies 66 can also best be seen in FIG. 7, and includes a toothed pulley 120 rotatably mounted on the machine frame, not shown in FIG. 7, a timing belt 122 being trained about the pulley 120 and the aforementioned drive pulley 106'' for imparting rotational movement to the pulley 120 upon rotation of the drive pulley 106'' by the motor 104. The pulley assembly 69 also includes four intermediate toothed pulleys 124, 125, 126, 127, all rotatably mounted to components, not shown, of the machine frame 40, a timing belt 128 being trained about these pulleys 124, 125, 126, 127. The intermediate pulley 124 is rigidly affixed coaxially with the pulley 120 to a shaft 123 affixed to and extending from the pulley 120, whereby rotational movement imparted to pulley 120 by rotation of the drive pulley 106'' by the drive motor 104 is transmitted to the intermediate pulley 124, 125, 126, 127. Another toothed pulley 125' of reduced diameter is rigidly affixed coaxially with the intermediate pulley 125 for rotation therewith. The aforementioned shaft 68 of one of the yarn reversing finger assemblies 66 is rigidly affixed coaxially to a toothed pulley 129 for rotation therewith, a timing belt 130 being trained about the pulley 125' and the pulley 129 to transmit to the pulley 129 and to the shaft 68 the rotational movement of the pulley 125. Similarly, the shaft 68 of the other yarn reversing finger assembly 66 is journaled in a bearing housing 132 (and thus not visible in FIG. 7) and coaxially affixed to a toothed pulley 134. Another toothed pulley 136, also rotatably mounted to a machine frame component, not shown, is rigidly affixed coaxially with the intermediate pulley 127 to a shaft 138 extending from the pulley 127, a timing belt 140 being trained about the pulleys 136 and 134 for imparting thereto and consequently to the shaft 68 the rotational movement of the intermediate pulley 127. As discussed hereinabove, the drive pulleys 106' and 106'' are rotated in a clockwise direction. Consequently, the various pulleys and belts of the pulley system 69 effect rotation of the yarn engaging fingers 72 in oppositely moving circular reversal paths 74, as is indicated by the directional arrows of FIG. 7, each extending outwardly of the ends of the package P and away from the traversal spans 56', 58' of belts 56, 58 for reversal engagement of the yarn in its feed path F outwardly of the package P beyond the traversal spans 56', 58'.

Figure 5:
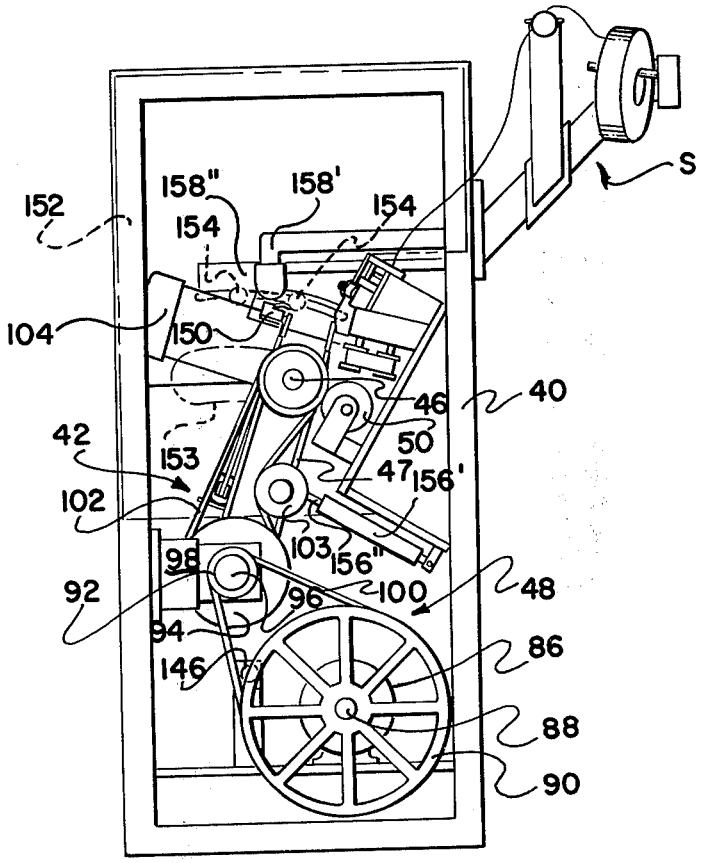
FIG. 5 is a right side elevational view of the winding machine of FIG. 1.

The aforementioned spindle driving assembly 48 can best be seen in FIGS. 1 and 5, and includes a conventionl electrically-operated motor 86 for rotating a drive shaft 88. Rigidly affixed concentrically to the drive shaft 88 for rotation therewith is a toothed main drive wheel 90. Two toothed intermediate drive wheels 92, 94 are rigidly affixed concentrically to opposite ends of a freely rotatable shaft 96 extending through and journaled in a bearing housing member 98 of the machine frame 40. A continuous timing belt 100 is trained about the main drive wheel 90 and the intermediate drive wheel 92 for imparting rotational movement to the intermediate drive wheels 92 and 94, a second continuous timing belt 102 being trained about the intermediate wheel 94, an idler roller 103, and one end of the spindle 46 for imparting rotational movement to the spindle 46.

As hereinabove discussed, the winding angle at which yarn is laid on the package with respect to the package axis is one of the primary factors in conventional devices limiting their capability for winding packages of yarn of large diameter and, therefore, it is preferable that some means be provided for varying the ratio between the rotational speed of the spindle and the longitudinal speed at which the yarn traversing arrangement traverses the yarn to effectively control the yarn winding angle and maintain it within acceptable limits. Additionally, with the advent and increasing use of synthetic yarns and filaments, it is preferable that means be provided for controlling the surface speed of the package during winding to thereby control one or more yarn characteristics or yarn feeding conditions, such as yarn take-up speed, yarn denier or yarn tension, to permit the winding of synthetic filament in conjunction with the extrusion process. Thus, in the preferred embodiment of the present invention, both the electric motor 86 of the spindle driving assembly 48 and the electric motor 104 of the traverse drive assembly 54 are of the conventional type of electric motor having a variable speed drive mechanism to permit, respectively, the rotation of the spindle 46 at varying rotational speeds to control the surface speed of the package P in relation to a selected yarn characteristic or yarn feeding condition to thereby control the yarn characteristic or feeding condition, and the varying of the longitudinal speed at which the yarn is traversed along the package P by the belts 54, 56 for regulation of the relationship of such speed with the rotational speed of the spindle 46 to thereby control the yarn winding angle. Each control process is independently actuated and regulated by a conventionally constructed, computerized control arrangement contained in the control box, indicated generally at 142, with the remaining machine control elements.

Figure 6:
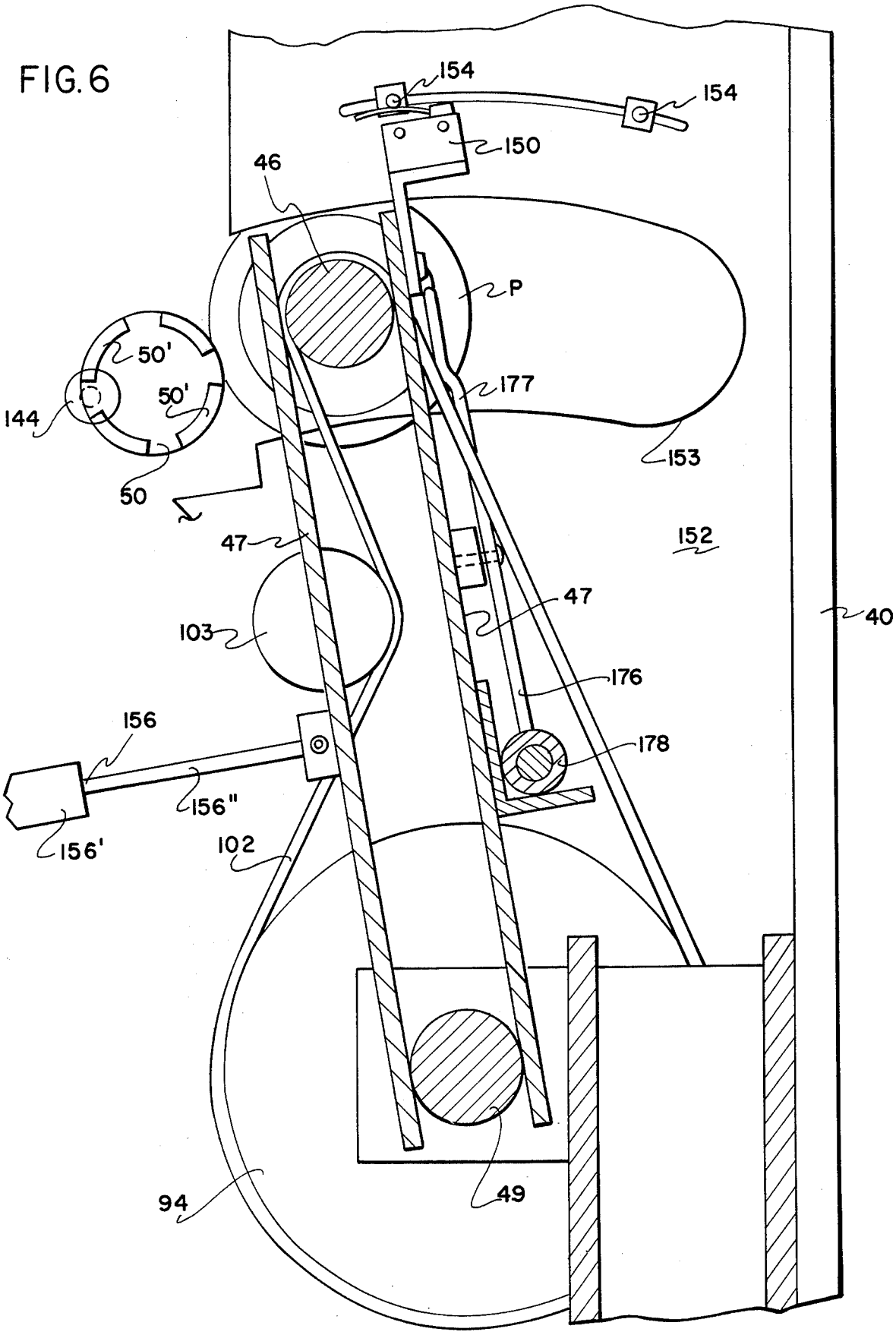
FIG. 6 is a sectional view taken along line 6—6 of FIG. 4.

The selected yarn characteristic or yarn feed condition to be controlled is preferably one which is variable in response to changes in the surface speed of the package P during winding, the selected characteristic or condition in the preferred embodiment being the speed of yarn take-up by the yarn package which, as will be understood by those skilled in the art, directly corresponds to the surface speed of the yarn package P. To facilitate the regulation by the computerized control arrangement of changes in the rotational speed of the spindle 46 to thereby control the surface speed of the package P and the yarn take-up speed, a package sensing arrangement is provided for monitoring the surface speed of the package P. Inasmuch as the freely rotatable roll 50 rotates during the winding operation at the same surface speed as the package P by virtue of the peripheral contact therebetween, the package sensing arrangement is arranged to detect the surface speed of the roll 50. For this purpose, the periphery of the roll 50 at one end thereof is provided with equally spaced arcuate projections 50' (FIG. 6) and a conventional electronic sensor 144 is disposed closely adjacent one point on the periphery of the roll 50 for sensing and detecting the passage of each arcuate projection 50' during rotation of the roll 50. The sensor 144 is operably associated with the control arrangement to register the passage of each arcuate projection 50' and thereby the peripheral speed of the roll 50 and therefore of the package P, the control arrangement being operably associated with the electric motor 86 of the spindle driving assembly 46 and being arranged in a conventional manner to compare the value registered by the sensor 144 with a predetermined standard value and operate the electric motor 86 to vary the rotational speed of the spindle 46 in response to the detected package surface speed to maintain the surface speed constant during the winding operation, thereby maintaining constant the speed at which yarn is taken-up by the package P.

In order to control the ratio between the rotational speed of the spindle 46 and the longitudinal speed at which the yarn is traversed by the belts 54, 56 and thereby control the yarn winding angle, the present invention also provides a spindle sensing arrangement for detecting at least periodically the speed of rotation of the package during the building thereof and a traverse sensing arrangement for detecting at least periodically the speed of traversing movement of the yarn. The spindle sensing arrangement includes a conventional electronic sensor 146 affixed to the machine frame 40 closely adjacent a point on the periphery of the main drive wheel 90 and operably associated with the control arrangement for sensing and detecting the passage of each tooth of the wheel 90 during the rotation thereof during the winding operation and registering such with the control arrangement. The traverse sensing arrangement also includes a conventional electronic sensor 148 affixed to a component of the frame 40 closely adjacent a point on the periphery of the pulley 125' and operably associated with the control arrangement for sensing and detecting the passage of each tooth of the pulley 125' during the rotation thereof during the winding operation and registering such with the control arrangement.

The control arrangement is arranged in conventional manner to electronically multiply the respective values registered therewith by the sensors 146 and 148 by preselected multipliers and to electrically compare the multiplied values to discern therefrom a value corresponding to the ratio between the rotational speed of the spindle 46 and the longitudinal speed of traversing movement of the yarn. The computerized control arrangement is also provided and programmed with an ordered set of ratio values corresponding to successive incremental increases in the package diameter during the winding operation, which ratio values have been predetermined to represent the optimum ratios at which the spindle and traverse assemblies should be operated during the intervals of the winding operation during which the incremental increases in package diameter respectively associated therewith are built. The computerized control arrangement is operably associated with the electric motor 104 of the traverse drive assembly 54 and is programmed to compare, in a conventional manner, the ratio value discerned by the control arrangement with the predetermined ratios value corresponding to the prevailing interval in the winding operation and to operate the electric motor 104 to accordingly vary the longitudinal speed at which the belts 56, 58 are moved in response to the comparison to maintain the ratio between the spindle rotational speed and the longitudinal speed of yarn traversing movement constant at the predetermined value corresponding to the prevailing winding operation interval.

As discussed hereinbefore, in any cross-winding operation the maximum increment of package diameter that can be built utilizing a rotating spindle and a yarn traversing assembly operating at a fixed ratio therebetween is limited, and therefore the computerized control arrangement of the present invention is provided with a switching mechanism operated conventionally in response to the incremental increases in the package diameter during winding corresponding to the aforementioned intervals in the winding operation with which the ordered set of predetermined ratio values are associated to cause the control arrangement to utilize such predetermined ratio values in a predetermined order so as to periodically change the prevailing predetermined ratio value with which the value discerned from sensors 146 and 148 is compared to thereby periodically change the ratio maintained between the spindle rotational speed and the yarn traversing speed. To effect the above-described switching operation, the pivoted arm 47 on which the spindle 46 is mounted is provided with an electronic switch 150 fixedly mounted thereon and operatively associated with the computerized control arrangement for actuating such switching operation. As the yarn package P builds and the diameter thereof increases, the spindle arrangement 42, including the spindle 46, the arm 47 and the switch 150, moves arcuately about the pivot point 49 of the arm 47 to accomodate the increasing diameter. A frame cover plate 152 is provided with an arcuate slot 153 to facilitate unrestricted arcuate movement of the spindle 46 with the arm 47 during winding. Bolts 154 are affixed to the cover plate 152 adjacent the arcuate path of movement of the switch 150 during the winding operation and extend from the cover plate 152 in intersection with such arcuate path at selected points along the arcuate path of the switch 150 corresponding to the abovementioned incremental increases in package diameter, for engagement of the switch 150 to actuate the above-described switching operation.

In this manner, the ratio between the rotational speed of the spindle 46 and the longitudinal speed at which the yarn is traversed is maintained at each of a plurality of predetermined ratio values for respective predetermined intervals of package size in a predetermined order of such ratio values by controlled variations in the speed of traversing the yarn along the package P, while the yarn take-up speed is controlled by controlled variations in the surface speed of the package P. Thus, the symmetrical building of yarn packages P of larger diameter than is conventionally possible may be accomplished by selecting and ordering an appropriate plurality of predetermined ratio values. In the preferred embodiment of the present invention, three predetermined ratio values are employed, and therefore only two bolts are provided for engagement of the switch 150. However, as those skilled in the art will understand, any number of predetermined ratio values may be employed if desired.

Referring now to FIG. 5, the present invention is illustrated in an early state of a winding operation with a relatively small amount of yarn having been wrapped thereabout. As will be understood by the disposition of the spindle 46 on which is supported the package P horizontally with respect to the point 49 about which the spindle arm 47 pivots during the building of a package, the package in this disposition is affected by gravitational forces and held against the roll 50 thereby. However, it will also be understood that as the package builds and the spindle arm 47 approaches a vertical disposition the gravitational forces acting thereof will have a gradually lessening effect in maintaining peripheral contact between the package P and the roll 50. The degree of peripheral contact between the package P and the roll 50 effected by the pressure exerted by the weight of the spindle 46 and the package P against the roll 50 during the initial stages of a winding operation is greater than is desirable for preferred package building conditions, while the degree of peripheral contact between the package P and the roll 50 during the later stages is less than desirable, it being preferable that a uniform degree of peripheral contact be maintained therebetween during the entire winding operation. For this purpose, a conventional air pressure actuated piston and cylinder assembly 156 and a conventional caliper brake assembly 158 are provided. The cylinder 156' of the piston and cylinder assembly 156 is affixed to a machine frame component with the piston 156'' thereof being affixed to the spindle arm 47 to provide a pushing force against the arm 47 to counteract the greater effect of gravitational forces during the early stages of winding. The caliper brake assembly 158 includes a caliper brake 158' rigidly affixed to and depending from the machine frame 40 above the spindle arm 47 for frictionally engaging a plate 158'' affixed to and extending upwardly from the arm 47, to create a frictional drag upon the pivotal movement of the arm 47 during the building of the package P to maintain the desired degree of peripheral contact between the package P and the roll 50.

Figure 19:
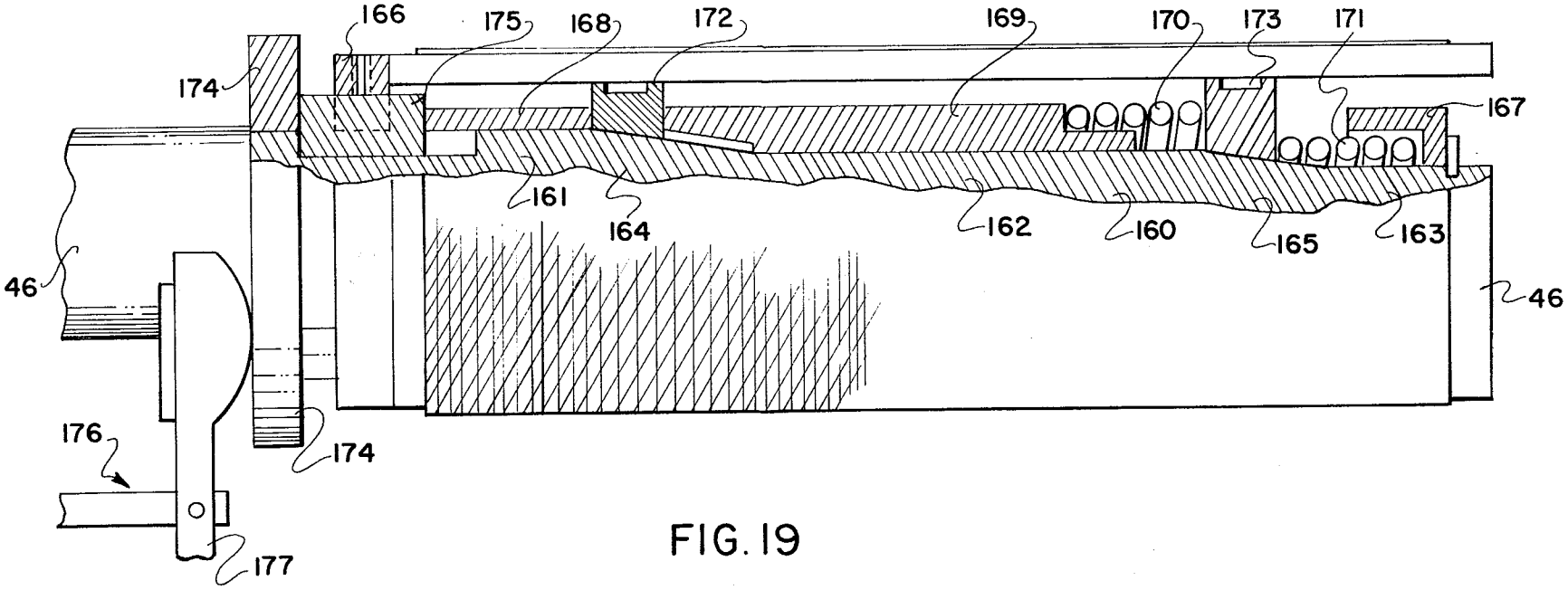
FIG. 19 is an elevation of the spindle partially broken away to a center section.

Utilizing the present invention, it is contemplated that yarn may be wound utilizing spindle rotational speeds approaching and exceeding 6,000 revolutions per minute. As a result, it is necessary that the package P be firmly supported on the spindle 46. For this purpose, the spindle 46 is constructed as illustrated in FIG. 19 with a central shaft 160 having three sections 161, 162, 163 of respectively different diameters and having two frusto-conical sections 164, 165 intermediate the sections 161, 162, 163 as "steps" therebetween. At the end of the spindle 46 at which it is attached to the spindle arm 47, a stop ring 166 is rigidly affixed about section 161, a second stop member 167 being rigidly affixed about section 163 at the other end of the spindle 46. Two cylindrical sleeves 168, 169 are slidably disposed respectively about sections 161 and 162 of the control shaft 160, sleeve 168 having a depressed region of decreased diameter at its outer end about which is disposed a coil spring 170. A second coil spring 171 is disposed about section 163 of the central shaft 160. Slidably disposed about the central shaft 160 intermediate the sleeves 168 and 169 is a clamping ring 172 having a slot extending transversely therethrough to permit the ring 172 to adapt to the diameter of either sections 162 or 164 for sliding movement along such sections, another slotted clamping ring 173 being slidably disposed about the shaft 160 intermediate springs 170 and 171 for sliding movement along sections 163 and 165, the two clamping rings 172, 173 normally resting, respectively, on the frusto-conical sections 164, 165 of the central shaft 160 under the biasing force of the springs 170 and 171.

A release ring 174 is slidably disposed about the central shaft 160 at the end of the spindle 46 at which it is affixed to the spindle arm 47, the release ring 174 being engagable with a plurality of keys 175 slidably disposed through slots 166' in the stop ring 166 to cause the keys 175 to engage and slide the sleeve 168 toward the opposite end of the spindle 46, thereby causing the clamping ring 172, the sleeve 169 and the clamping ring 173 to also slide in that direction and compress the springs 170 and 171. In this manner, the clamping rings 172 and 173 are disposed respectively about the sections 162 and 163 of the central shaft 160 with the slots thereof generally closed, thereby causing the spindle 46 to assume a smaller diameter to facilitate the positioning of a package core C about the spindle 46 or the removal of a package P therefrom.

Figure 2:
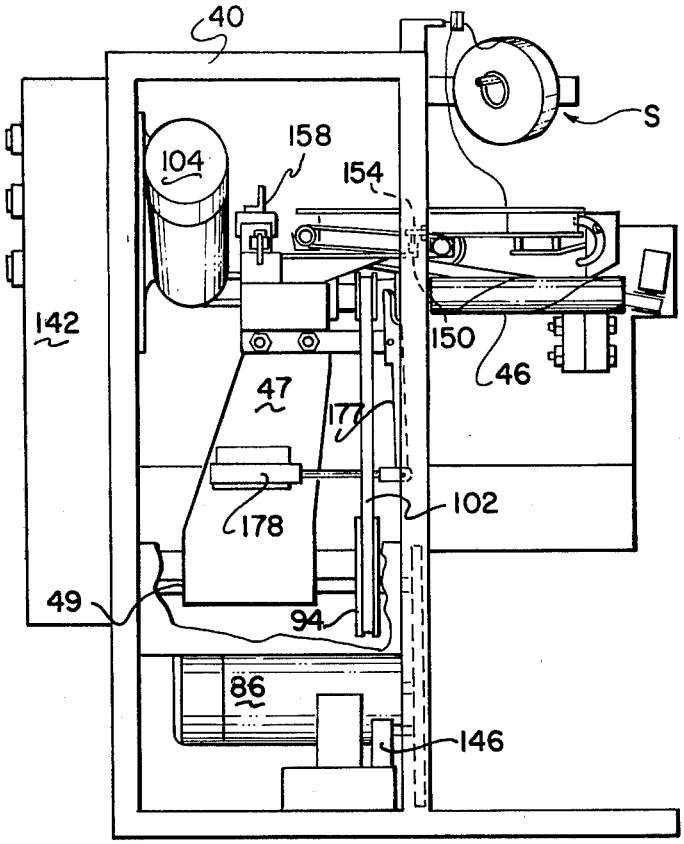
FIG. 2 is a front elevational view of the winding machine of FIG. 1.
Figure 3:
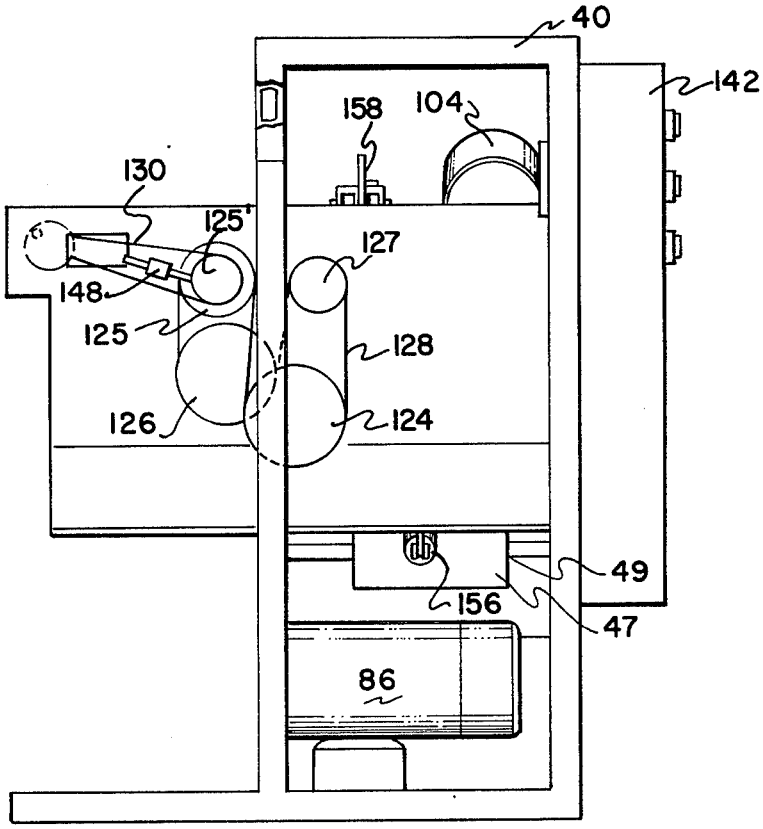
FIG. 3 is a rear elevational view of the winding machine of FIG. 1.
Figure 4:
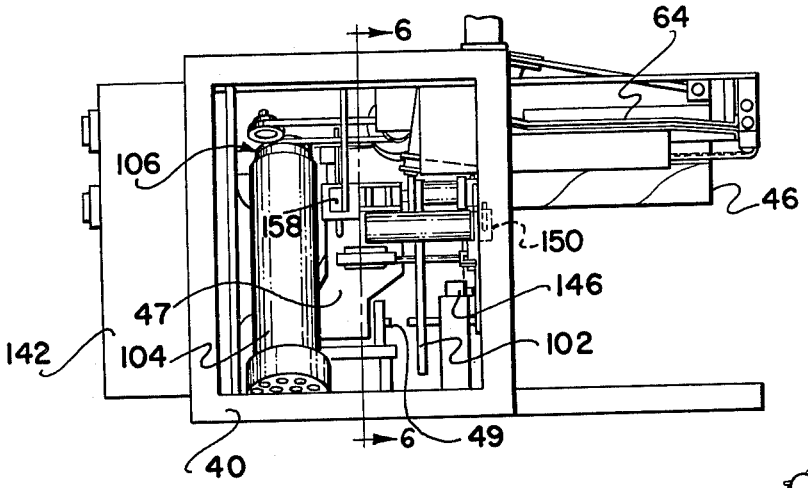
FIG. 4 is a plan view of the winding machine of FIG. 1.

The winding machine of the present invention also provides a mechanism for actuating the above described sliding package releasing movement of the release ring 174, which mechanism is indicated generally at 176 in FIGS. 1 and 2. The package release mechanism 176 comprises a pivotable arm 177 pivotably affixed to the spindle arm 47 and having upwardly extending legs disposed for engaging and sliding the release ring 174 in the above-described manner upon pivoting of the arm. Operably associated with the arm is a conventional air cylinder assembly 178 which is also operably associated with appropriate controls mounted on the control box 142 for actuating operable pivotal movement of the arm 177 to facilitate the loading of a package core C or removal of a package P.

The apparatus and method of the present invention have been herein illustrated and described in detail with regard to the preferred embodiment thereof for purposes of illustration only, to facilitate an accurate and complete understanding of the best mode of carrying out the present invention. As those skilled in the art will readily understand, modifications and variations may be resorted to without departing from the substance or scope of the present invention. Such modifications and variations are within the scope of the present invention which is intended to be limited only by the appended claims and equivalents thereof.

I claim:

1. An apparatus for winding yarn from a supply into a yarn package comprising:

(a) spindle means for rotatably supporting a package core for winding thereon yarn delivered thereto from said supply along a yarn feed path to form said yarn package, (b) yarn traversing means for effecting traversing movement of said yarn along said yarn package, said traversing means including yarn guides movable oppositely along two traversal spans extending longitudinally of said yarn package from respectively opposite yarn engaging locations adjacent the periphery of said package at opposite ends thereof toward respectively opposite yarn disengaging locations adjacent the periphery of said package at the respective other ends thereof, said yarn guides being engagable with said yarn to guide it alternately along said traversal spans from said yarn engaging locations to said yarn disengaging locations, and (c) movable reversing means adjacent each end of said yarn package for transferring said yarn from a yarn guide at the yarn disengaging location of one traversal span to a yarn guide at the yarn engaging location of the other traversal span, each said reversing means having yarn engaging means arranged for movement including movement generally transverse to said traversal spans and intersecting said yarn feed path for positively engaging said yarn as a yarn guide guiding said yarn passes through the yarn disengaging location of one traversal span and positively moving said yarn away and out of engagement with said yarn guide and into position for engagement at the yarn engaging location of the other traversal span by a yarn guide moving therethrough for movement along the other traversal span.

2. An apparatus for winding yarn from a supply into a yarn package according to claim 1 and characterized further in that said yarn traversing means includes belt means movable oppositely along said two traversal spans, said belt means having said yarn guides thereon.

3. An apparatus for winding yarn from a supply into a yarn package according to claim 1 and characterized further in that each said yarn engaging means includes a movable yarn engaging finger for positively engaging and moving said yarn between said traversal spans.

4. An apparatus for winding yarn from a supply into a yarn package according to claim 2 and characterized further in that said belt means is arranged to cause a yarn guide not engaging said yarn to move through the yarn engaging location of one of said traversal spans as the yarn guide guiding said yarn along the other of said traversal spans moves through the yarn disengaging location thereof for transfer of said yarn by said reversing means from the yarn guide in said other traversal span to the yarn guide in said one traversal span.

5. An apparatus for winding yarn from a supply into a yarn package according to claim 1 and characterized further in that each said yarn engaging means is arranged for movement in a reversal path during each transferring thereby of said yarn from one traversal span to the other, each said reversal path including a portion through which said yarn engaging means has one component of movement in the general direction of movement of the yarn guide in said yarn disengaging location and another component of movement generally transversely away therefrom, each said reversing means being arranged to move its yarn engaging means along said portion at at least the same general speed as said yarn guide as said yarn guide moves through said yarn disengaging location of said one traversal span for positively engaging said yarn and disengaging it from said yarn guide.

6. An apparatus for winding yarn from a supply into a yarn package according to claim 5 and characterized further in that during every transferring of yarn between said traversal spans, the yarn engaging means of said reversing means effecting transferral temporarily continues to engage said yarn following engagement of said yarn by the yarn guide to which said yarn was transferred, thereby maintaining tension on said yarn during transferring thereof between said traversal spans.

7. An apparatus for winding yarn from a supply into a yarn package according to claim 6 and characterized further in that said reversal path is a circular path and includes a second portion following said first-mentioned portion in which a primary component of movement of said yarn engaging means is generally normal to the movement of the yarn guide in said yarn engaging location for advancing said yarn into position for engagement by the yarn guide moving through said yarn engaging location.

8. An apparatus for winding yarn from a supply into a yarn package according to claim 7 and characterized further in that said circular path includes a third portion following said second portion through which said yarn engaging means has one component of movement in the general direction of movement of said yarn guide in said yarn engaging location and another component of movement generally transversely away therefrom for disengaging and moving away from said yarn.

9. An apparatus for winding yarn from a supply into a yarn package according to claim 8 and characterized further in that said traversal spans extend in generally transverse relation to said yarn feed path on opposite sides thereof, each said reversing means being arranged such that the circular path of the yarn engaging means thereof lies in a plane inclined to said traversal spans for transferring said yarn out of the path of the guide in said yarn disengaging location into the path of the guide in said yarn engaging location and for moving said yarn engaging means out of engagement with said yarn and away from said yarn feed path after transferring said yarn.

10. An apparatus for winding yarn from a supply into a yarn package according to claim 9 and characterized further in that said yarn engaging means includes a yarn engaging finger, said yarn engaging finger being movable in said reversal path for positively engaging and moving said yarn between said traversal spans.

11. An apparatus for winding yarn from a supply into a yarn package according to claim 5 and characterized further in that said traversal spans extend in generally transverse relation to said yarn feed path on opposite sides thereof, each said reversing means being arranged such that the reversal path of the yarn engaging means thereof lies in a plane inclined to said traversal spans for transferring said yarn out of the path of the guide in said yarn disengaging location into the path of the guide in said yarn engaging location and for moving said yarn engaging means out of engagement with said yarn and away from said yarn feed path after transferring said yarn.

12. An apparatus for winding yarn from a supply into a yarn package according to claim 11 and characterized further in that said yarn traversing means and said reversing means move said yarn in a yarn traversal path extending during traversal thereof generally longitudinally of said package in a plane generally parallel to the axis of said package and extending during each reversal thereof between said traversal spans in a plane inclined to said traversal path plane.

13. An apparatus for winding yarn from a supply into a yarn package according to claim 5 or 9 and characterized further in that said traversal spans are arranged adjacent said package between said reversing means and said package such that said reversal paths of the yarn engaging means of said reversing means intersect said yarn feed path outwardly of said package beyond said traversal spans.

14. An apparatus for winding yarn from a supply into a yarn package according to claim 13 and characterized further in that said traversal spans are of equal length and extend in generally parallel planes.

15. An apparatus for winding yarn from a supply into a yarn package according to claim 13 and characterized further in that said traversal spans are arranged closely adjacent said yarn feed path in parallel planes.

16. An apparatus for winding yarn from a supply into a yarn package according to claim 15 and characterized further by a freely rotatable roll disposed in axially parallel relation with said package for peripheral contact therewith during winding of yarn thereof, said yarn feed path extending from said supply to said roll and package for application of said yarn onto said package.

17. An apparatus for winding yarn from a supply into a yarn package according to claim 1 or 5 and characterized further in that said two traversal spans of said yarn traversing means extend in crossing relation angularly outwardly from said yarn package from their respective yarn engaging locations to their respective yarn disengaging locations, said yarn engaging locations being generally closely adjacent the periphery of said yarn package and said yarn disengaging locations being spaced from the periphery of said yarn package, whereby during each transferring of yarn between said two traversal spans said yarn guide to which said yarn is transferred is generally closely adjacent said yarn package and more closely adjacent said package than said yarn guide from which said yarn is disengaged so as to effect a quick and precise reversing of the direction of traversing movement of said yarn for symmetrical controlled package building.

18. An apparatus for winding yarn from a supply into a yarn package according to claim 17 and characterized further in that said traversal spans extend in parallel planes and in generally transverse relation to said yarn feed path on opposite sides thereof for traversing said yarn along a yarn traversal path extending between said traversal spans.

19. An apparatus for winding yarn from a supply into a yarn package according to claim 18 and characterized further in that said yarn guides extend toward said yarn feed path during movement of said yarn guides along said traversal spans.

20. An apparatus for winding yarn from a supply into a yarn package according to claim 19 and characterized further in that said yarn traversing means includes belt means movable oppositely along said two traversal spans, said belt means including edges extending longitudinally therealong and being generally flat between said edges and along the longitudinal extent thereof, said belt means being inclined in cross-section in each said traversal span to converge toward said yarn feed path in the direction of said yarn package with an edge thereof along each said traversal span closely adjacent said yarn feed path, said yarn guides extending from the edges thereof closely adjacent said yarn feed path for disposition close to said package at said yarn engaging location.

21. An apparatus for winding yarn from a supply into a yarn package according to claim 20 and characterized further in that said belt means includes two continuous belts respectively oppositely movable generally axially of said yarn package along said two traversal spans.

22. An apparatus for winding yarn from a supply into a yarn package according to claim 20 and characterized further in that said traversal spans are of equal length and extend angularly outwardly from said yarn package at equal inclinations with respect to the axis of said package.

23. An apparatus for winding yarn from a supply into a yarn package according to claim 22 and characterized further in that said traversal spans are arranged generally closely adjacent said package between said reversal means and said package.

24. An apparatus for winding yarn from a supply into a yarn package according to claim 17 and characterized further in that said spindle means includes variable spindle drive means for rotating said package at varying rotational speeds to control the surface speed of said package in relation to a selected yarn characteristic or yarn feeding condition to thereby control said selected yarn characteristic or yarn feeding condition, and in that said yarn traversing means includes traverse drive means for causing said yarn traversing means to move said yarn generally longitudinally along said package, said traverse drive means being variable for varying the longitudinal speed of traversing movement of yarn for regulation of the relationship thereof with the rotational speed of said package to thereby control the angle with respect to the axis of said package at which said yarn is wound onto said package.

25. An apparatus for winding yarn from a supply into a yarn package according to claim 24 and characterized further by spindle sensing means for detecting at least periodically the speed of rotation of said package during building thereof, traverse sensing means for detecting at least periodically the speed of traversing movement of said yarn, and control means operatively associated with both said spindle sensing means and said traverse sensing means for monitoring the respective values detected thereby and for comparing said respective values to discern the ratio therebetween, and operatively associated with said traverse drive means for varying the speed of traversing movement of said yarn in response to said comparison to control said ratio, said control means being provided with a plurality of predetermined ratio values and being programmed to operate said traverse drive means so as to maintain said ratio at each said predetermined ratio value for respective preselected intervals in a predetermined order of said ratio values to maintain said yarn winding angle within a predetermined acceptable range throughout the yarn winding operation for symmetrical building of large yarn packages.

26. An apparatus for winding yarn from a supply into a yarn package according to claim 25 and characterized further in that said selected yarn characteristic or yarn feeding condition is the speed of yarn take-up by said package, said variable spindle drive means including package sensing means for continuously detecting the surface speed of said package, said control means being independently operably associated with said spindle drive means for comparing the surface speed of said package with a predetermined standard value and varying the rotational speed of said package to maintain constant the surface speed of said package, thereby maintaining constant the speed at which said yarn is taken up by said package.

27. An apparatus for winding yarn from a supply into a yarn package according to claim 26 and characterized further by a freely rotatable roll disposed in axially parallel relation with said package for peripheral rotational contact therewith during winding of yarn thereon to cause said roll to rotate at the surface speed of said package, said package sensing means being arranged to detect the surface speed of said roll.

28. An apparatus for winding yarn from a supply into a yarn package, comprising:

(a) spindle means for rotatably supporting a package core for winding yarn thereon to form said yarn package, (b) yarn trasversing means for effecting traversing movement of said yarn along said yarn package, said traversing means including belt means movable oppositely along two traversal spans extending longitudinally of said yarn package in crossing relation from respectively opposite yarn engaging locations generally closely adjacent the periphery of said yarn package at opposite ends thereof angularly outwardly from said yarn package toward respectively opposite yarn disengaging locations spaced from the periphery of said yarn package at the respective other ends thereof, said belt means having yarn guides thereon for movement along said two traversal spans and engagable with said yarn to guide it alternately along said traversal spans from said yarn engaging locations to said yarn disengaging locations, and (c) reversal means adjacent each end of said package for transferring said yarn from a yarn guide at the disengaging location of one span to a yarn guide at the engaging location of the other span, whereby during each transferring of yarn between said two traversal spans said yarn guide to which said yarn is transferred is closely adjacent said package and more closely adjacent said package than said yarn guide from which said yarn is disengaged so as to effect a quick and precise reversing of the direction of traversing movement of said yarn for symmetrical, controlled package building.

29. An apparatus for winding yarn from a supply into a yarn package according to claim 28 and characterized further in that said traversal spans of said belt means are of equal length and extend in generally parallel planes.

30. An apparatus for winding yarn from a supply into a yarn package according to claim 28 and characterized further in that said belt means is arranged to cause a yarn guide not engaging said yarn to move through the yarn engaging location of one of said traversal spans as the yarn guide guiding said yarn along the other of said traversal spans moves through the yarn disengaging location thereof for transfer of said yarn by said reversal means from the yarn guide in said other traversal span to the yarn guide in said one traversal span.

31. An apparatus for winding yarn from a supply into a yarn package according to claim 28 and characterized further in that said yarn is delivered for winding along a yarn feed path extending from said supply to said package, and in that said traversal spans extend in generally transverse relation to said yarn feed path on opposite sides thereof for traversing said yarn along a yarn traversal path extending between said traversal spans.

32. An apparatus for winding yarn from a supply into a yarn package according to claim 31 and characterized further in that said traversal spans are arranged closely adjacent said yarn feed path in parallel planes.

33. An apparatus for winding yarn from a supply into a yarn package according to claim 31 or 32 and characterized further in that said yarn guides extend from said belt means toward said yarn feed path during movement of said yarn guides along said traversal spans.

34. An apparatus for winding yarn from a supply into a yarn package according to claim 33 and characterized further in that said belt means includes edges extending longitudinally therealong and is generally flat between said edges and along the longitudinal extent thereof, said belt means being inclined in cross-section in each said traversal span to converge toward said yarn feed path in the direction ofsaid yarn package with an edge thereof along each said traversal span closely adjacent said yarn feed path, said yarn guides extending from the edges thereof closely adjacent said yarn feed path for disposition close to said package at said yarn engaging location.

35. An apparatus for winding yarn from a supply into a yarn package according to claim 32 and characterized further by a freely rotatable roll disposed in axially parallel relation with said package for peripheral contact therewith during winding of yarn thereon, said yarn feed path extending from said supply to said roll and package for application of said yarn onto said package.

36. An apparatus for winding yarn from a supply into a yarn package according to claim 35 and characterized further in that said traversal spans are arranged with their yarn engaging locations generally closely adjacent said roll and said package.

37. An apparatus for winding yarn from a supply into a yarn package according to claim 36 and characterized further in that said yarn guides extend from said belt means toward said yarn feed path during movement of said yarn guides along said traversal spans.

38. An apparatus for winding yarn from a supply into a yarn package according to claim 37 and characterized further in that said belt means includes edges extending longitudinally therealong and is generally flat between said edges and along the longitudinal extent thereof, said belt means being inclined in cross-section in each said traversal span to converge toward said yarn feed path in the direction of said yarn package with an edge thereof along each said traversal span closely adjacent said yarn feed path, said yarn guides extending from the edges thereof closely adjacent said yarn feed path for disposition close to said package.

39. An apparatus for winding yarn from a supply into a yarn package according to claim 28 or 38 and characterized further in that said belt means includes two continuous belts respectively oppositely moveable generally axially of said yarn package along said two traversal spans.

40. An apparatus for winding yarn from a supply into a yarn package according to claim 39 and characterized further in that said traversal spans are of equal length, the length of each said belt means being a multiple of the length of said traversal spans.

41. An apparatus for winding yarn from a supply into a yarn package comprising:

(a) spindle means for rotatably supporting a package core for winding yarn thereon from said supply to form said yarn package, said spindle means including variable spindle drive means for rotating said package at varying rotational speeds to control the surface speed of said package in relation to a selected yarn characteristic or yarn feeding condition to thereby control said selected yarn characteristic or yarn feeding condition, (b) yarn traversing means for effecting traversing movement of said yarn generally longitudinally along said package, said yarn traversing means including traverse drive means for causing said yarn traversing means to move said yarn generally longitudinally along said package, said traverse drive means being variable for varying the longitudinal speed of traversing movement of said yarn for regulation of the relationship thereof with the rotational speed of said package to thereby control the angle with respect to the axis of said package at which said yarn is wound onto said package, (c) spindle sensing means for detecting at least periodically the speed of rotation of said package during building thereof, (d) traverse sensing means for detecting at least periodically the speed of traversing movement of said yarn, and (e) control means operatively associated with both said spindle sensing means and said traverse sensing means for monitoring the respective values detected thereby and for comparing said respective values to discern the ratio therebetween, and operatively associated with said traverse drive means for varying the speed of traversing movement of said yarn in response to said comparison to control said ratio, said control means being provided with a plurality of predetermined ratio values and being programmed to operate said traverse drive means so as to maintain said ratio at each said predetermined ratio value for a respective preselected interval in a predetermined order of said ratio values to maintain said yarn winding angle within a predetermined acceptable range throughout the yarn winding operation for symmetrical building of large yarn packages.

42. An apparatus for winding yarn from a supply into a yarn package according to claim 41 and characterized further in that said selected yarn characteristic or yarn feeding condition is variable in response to changes in the surface speed of said package during winding of said yarn thereon.

43. An apparatus for winding yarn from a supply into a yarn package according to claim 41 and characterized further in that said selected yarn characteristic or yarn feeding condition is the speed of yarn take-up by said package, said variable spindle drive means including package sensing means for continuously detecting the surface speed of said package, said control means being independently operably associated with said spindle drive means for comparing the surface speed of said package with a predetermined standard value and varying the rotational speed of said package to maintain constant the surface speed of said package, thereby maintaining constant the speed at which said yarn is taken up by said package.

44. An apparatus for winding yarn from a supply into a yarn package according to claim 43 and characterized further by a freely rotatable roll disposed in axially parallel relation with said package for peripheral rotational contact therewith during winding of yarn thereon to cause said roll to rotate at the surface speed of said package, said package sensing means being arranged to detect the surface speed of said roll.

45. A method of winding yarn into a yarn package comprising the steps of:

(a) continuously rotating a package core, while (b) delivering said yarn to said package core along a yarn feed path and applying said yarn thereto, while (c) traversing said yarn in said yarn feed path generally longitudinally along said package by continuously repeating the steps of engaging said yarn at one end of said package adjacent the periphery thereof, guiding said yarn longitudinally of said package along a traversal span toward the opposite end of said package, engaging said yarn at said opposite end of said package adjacent the periphery thereof as said yarn is guided thereto, and guiding said yarn longitudinally of said package along another traversal span toward said one end of said package, and (d) at each end of said package, reversing the direction of traversing movement of said yarn by positively engaging said yarn with a disengaging means intersecting said yarn feed path in the traversal span along which said yarn has been guided and positively moving said disengaging means relative to the traversal spans to positively move said yarn initially generally in the direction in which it has been guided to complete said traversing movement and thereafter transversely of the traversal spans to positively move said yarn away from said traversal span and into position for said engaging of said yarn adjacent the periphery of said package in the other travesal span.

46. A method of winding yarn into a yarn package according to claim 45 and characterized further in that said positively engaging said yarn includes maintaining tension on said yarn during said engaging and moving thereof.

47. A method of winding yarn into a yarn package according to claim 45 and characterized further in that each said traversing engaging of said yarn at said ends of said package includes engaging said yarn generally closely adjacent the periphery of said package, and each said traversing guiding of said yarn includes guiding said yarn along a traversal span angularly outwardly of said package toward the opposite end thereof whereby, during each traversing, said yarn is engaged generally closely adjacent said package to effect a quick and precise reversing of the direction of traversing movement.

48. A method of winding yarn to produce a symmetrical yarn package of large diameter, comprising the steps of:

(a) continuously rotating a package core while delivering and applying said yarn to said package core and traversing said yarn generally longitudinally along said package, (b) controlling a selected yarn characteristic or yarn feeding condition by controlling the surface speed of said package during winding in relation to said yarn characteristic or feeding condition, (c) at least periodically detecting the rotational speed of said package and the speed of traversing movement of said yarn longitudinally along said package, (d) comparing the rotational speed of said package and the speed of traversing movement of said yarn and discerning therefrom a ratio therebetween, and (e) maintaining said ratio at each of a plurality of predetermined ratio values for respective predetermined intervals of package size in a predetermined order of said ratio values by, during each predetermined interval, varying the longitudinal speed of traversing travel of said yarn in response to said comparing to maintain said ratio at the respective predetermined ratio value associated with the interval, and, at the expiration of each said interval, varying the longitudinal speed of traversing travel of said yarn to change said ratio to the next predetermined ratio value in said order of ratio values.

49. A method of winding yarn to produce a yarn package according to claim 48 and characterized further in that said yarn characteristic or yarn feeding condition is the speed of yarn take-up by said package, said controlling said yarn characteristic or feeding condition including maintaining the surface speed of said yarn package constant during winding by varying the rotational speed as said yarn is wound thereon.

* * * * *

UNITED STATES PATENT OFFICE

CERTIFICATE OF CORRECTION

Patent No. 4,349,160 Dated Sept. 14, 1982

Inventor(s) Kurt W. Niederer

It is certified that error appears in the above-identified patent and that said Letters Patent are hereby corrected as shown below:

Column 2, lines 30 and 31, delete "coefficiente" and insert therefor --coefficient--. Column 4, line 14, after "surface" insert --speed--. Column 4, line 47, delete "accordingly" and insert therefor --according--. Column 4, line 65, delete "end" and insert therefor --ends--. Column 7, line 20, delete "detacted" and insert therefor --detected--. Column 9, line 37, delete "loaction" and insert therefor --location--. Column 9, line 68, delete "though" and insert therefor --through--. Column 15, line 68, delete "tionl" and insert therefor --tional--. Column 17, line 66, delete "ratios value" and insert therefor --ratio values--. Column 21, line 8, after "away" insert --from--. Column 26, line 3, delete "ofsaid" and insert therefor --of said--. Column 28, line 16, delete "travesal" and insert therefor --traversal--.

Signed and Sealed this

Seventh Day of May 1985

[SEAL]

*Attest:*

DONALD J. QUIGG

*Attesting Officer* *Acting Commissioner of Patents and Trademarks*